US011710922B2

(12) United States Patent
Nakamura et al.

(10) Patent No.: US 11,710,922 B2
(45) Date of Patent: Jul. 25, 2023

(54) CONNECTOR

(71) Applicant: Japan Aviation Electronics Industry, Limited, Tokyo (JP)

(72) Inventors: Keisuke Nakamura, Tokyo (JP); Akira Kimura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 136 days.

(21) Appl. No.: 17/473,217

(22) Filed: Sep. 13, 2021

(65) Prior Publication Data

US 2022/0158377 A1 May 19, 2022

(30) Foreign Application Priority Data

Nov. 18, 2020 (JP) ..... 2020-191640

(51) Int. Cl.

| | |
|---|---|
| ***H01R 13/24*** | (2006.01) |
| ***H01R 12/59*** | (2011.01) |
| ***H01R 13/42*** | (2006.01) |
| ***H01R 13/502*** | (2006.01) |
| ***H01R 13/639*** | (2006.01) |

(52) U.S. Cl.

CPC ..... *H01R 13/2407* (2013.01); *H01R 12/59* (2013.01); *H01R 13/42* (2013.01); *H01R 13/502* (2013.01); *H01R 13/639* (2013.01)

(58) Field of Classification Search

CPC ..... H01R 12/778; H01R 13/502; H01R 4/50; H01R 12/7011; H01R 13/41; H01R 12/65; H01R 12/592; H01R 13/2407; H01R 13/02

See application file for complete search history.

(56) References Cited

U.S. PATENT DOCUMENTS 4,640,561 A * 2/1987 George ..... H01R 12/592 439/77
5,240,430 A * 8/1993 Soes ..... H01R 12/592 439/495

(Continued)

FOREIGN PATENT DOCUMENTS

JP 2019-87515 A 6/2019

OTHER PUBLICATIONS

High-Density Flexible Circuit Connector, IBM Technical Disclosure Bulletin, Oct. 1990, pp. 181-184, vol. 33, No. 5, Armonk, NY, US.

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

In a connector, a contact includes: a first connection portion and a second connection portion that are retained between a first insulator and a second insulator and face each other; and a pressing force receiving portion that makes contact with the second insulator and receives a pressing force from the second insulator to thereby press the first connection portion against the second connection portion. A connection object is sandwiched between the first connection portion and the second connection portion, and at least one of the first connection portion and the second connection portion makes contact with a flexible conductor of the connection object, whereby the contact is electrically connected to the flexible conductor of the connection object.

16 Claims, 27 Drawing Sheets

(56) References Cited

U.S. PATENT DOCUMENTS

| | | | | |
|---|---|---|---|---|
| 10,868,380 | B1 * | 12/2020 | Komoto | H01R 12/771 |
| 10,886,650 | B1 * | 1/2021 | Komoto | H01R 12/592 |
| 2019/0148901 | A1 * | 5/2019 | Komoto | H01R 13/502 439/271 |
| 2021/0210882 | A1 * | 7/2021 | Peterson | H01R 13/2492 |
| 2022/0158373 | A1 * | 5/2022 | Komoto | H01R 12/592 |
| 2022/0158377 | A1 * | 5/2022 | Nakamura | H01R 13/2407 |
| 2022/0302617 | A1 * | 9/2022 | Komoto | H01R 12/592 |

* cited by examiner

CONNECTOR

BACKGROUND OF THE INVENTION

The present invention relates to a connector, particularly to a connector attached to a connection object having a flexible conductor exposed on at least one surface of the connection object.

BACKGROUND ART

As a connector attached to a connection object having a flexible conductor, for instance, JP 2019-87515 A discloses a connector 1 shown in FIG. 67. The connector 1 has a structure in which a connection object 4 is sandwiched and held between a first insulating member 2 of flat plate shape and a second insulating member 3 of frame shape having an opening 3A in its center.

In the first insulating member 2, there are formed convex portions 2A projecting in the opening 3A of the second insulating member 3 and projections 2B projecting toward the second insulating member 3 at positions closer to the lateral edge portions of the first insulating member 2 than the convex portions 2A are. Contacts 5 are retained by the first insulating member 2 to be exposed on surfaces of the convex portions 2A and the projections 2B. Projection accommodating portions 3B of recess shape for accommodating the projections 2B of the first insulating member 2 are formed at the surface of the second insulating member 3 that faces the first insulating member 2.

The connection object 4 has a flexible conductor 6 exposed on the bottom surface of the connection object 4, i.e., the surface facing the first insulating member 2. When the first insulating member 2 and the second insulating member 3 are pushed to approach each other in the state where the connection object 4 is disposed between the first and second insulating members 2 and 3, as shown in FIG. 68, the connection object 4 is inserted into the projection accommodating portion 3B of the second insulating member 3 by the projection 2B of the first insulating member 2. Consequently, the connection object 4 is sandwiched between the inner surface of the projection accommodating portion 3B and part of the contact 5 disposed on the surface of the projection 2B of the first insulating member 2, so that the contact 5 is electrically connected to the flexible conductor 6 exposed on the bottom surface of the connection object 4.

Meanwhile, another part of the contact 5 that is situated on the surface of the convex portion 2A of the first insulating member 2 makes contact with and is electrically connected to the corresponding contact of a counter connector when a part of the counter connector is inserted into the opening 3A of the second insulating member 3 and the counter connector is fitted to the connector 1.

Thus, the use of the connector 1 of JP 2019-87515 A makes it possible to electrically connect the contact 5 to the flexible conductor 6 exposed on the bottom surface of the connection object 4.

However, since the bottom surface of the connection object 4 makes contact with the contact 5 in the projection accommodating portion 3B of the second insulating member 3, in the case where the flexible conductor 6 is exposed not on the bottom surface but only on the top surface of the connection object 4, the contact 5 cannot be electrically connected to the flexible conductor 6.

SUMMARY OF THE INVENTION

The present invention has been made to solve the foregoing problem and aims at providing a connector that enables to make an electrical connection of a contact to a flexible conductor of a connection object regardless of whether the flexible conductor is exposed on the top surface or the bottom surface of the connection object.

A connector according to the present invention is a connector attached to a connection object having a flexible conductor exposed on at least one surface of the connection object, the connector comprising:

a first insulator;

a second insulator assembled to the first insulator in a predetermined assembling direction; and at least one contact made of a conductive material, wherein the contact includes a contact portion that is to make contact with a contact of a counter connector, a retained portion that is retained between the first insulator and the second insulator, a first connection portion and a second connection portion that face each other and make contact with opposite surfaces of the connection object, and a pressing force receiving portion that makes contact with the second insulator and receives a pressing force from the second insulator to thereby press the first connection portion against the second connection portion, the connection object is sandwiched between the first connection portion and the second connection portion, and at least one of the first connection portion and the second connection portion makes contact with the flexible conductor of the connection object, whereby the contact is electrically connected to the flexible conductor of the connection object.

DETAILED DESCRIPTION OF THE INVENTION

Embodiments of the present invention are described below with reference to the accompanying drawings.

Embodiment 1

Figure 1:
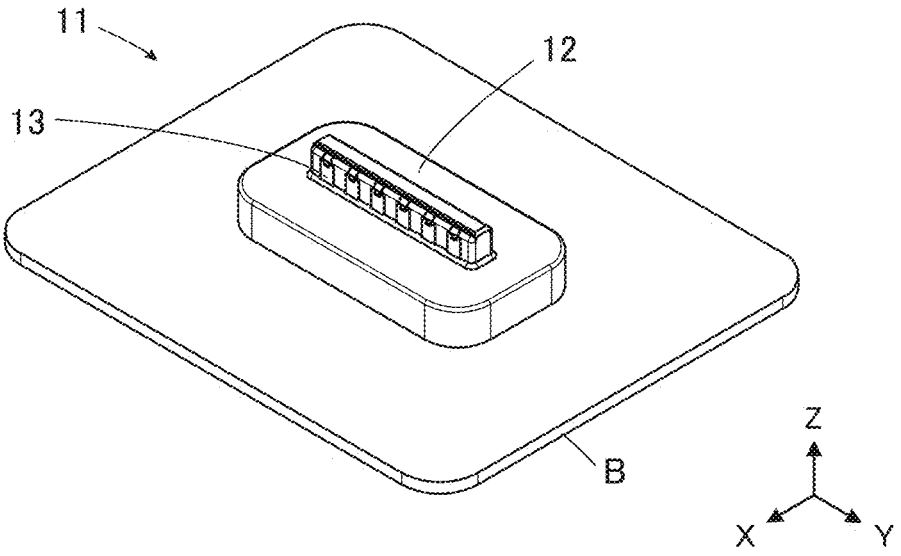
FIG. 1 is a perspective view of a connector according to Embodiment 1 attached to a connection object, as viewed from an obliquely upper position.
Figure 2:
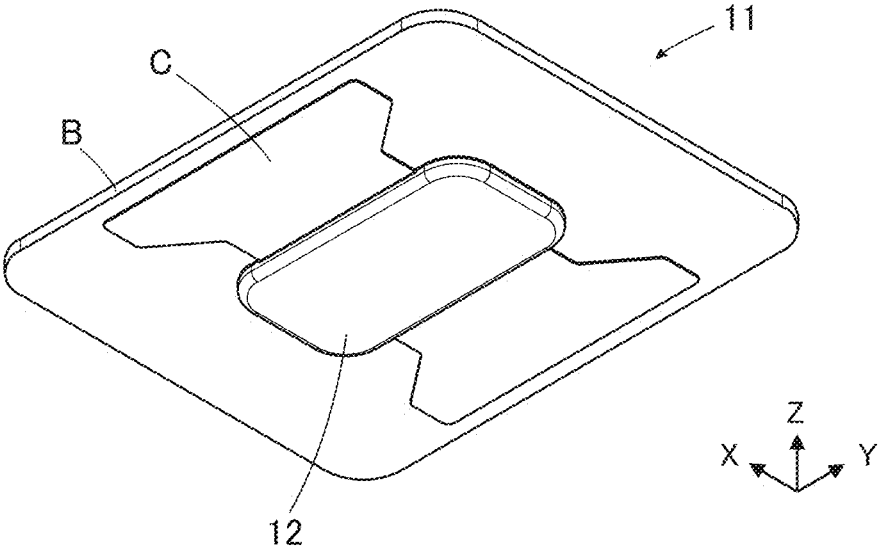
FIG. 2 is a perspective view of the connector according to Embodiment 1 attached to the connection object, as viewed from an obliquely lower position.
Figure 3:
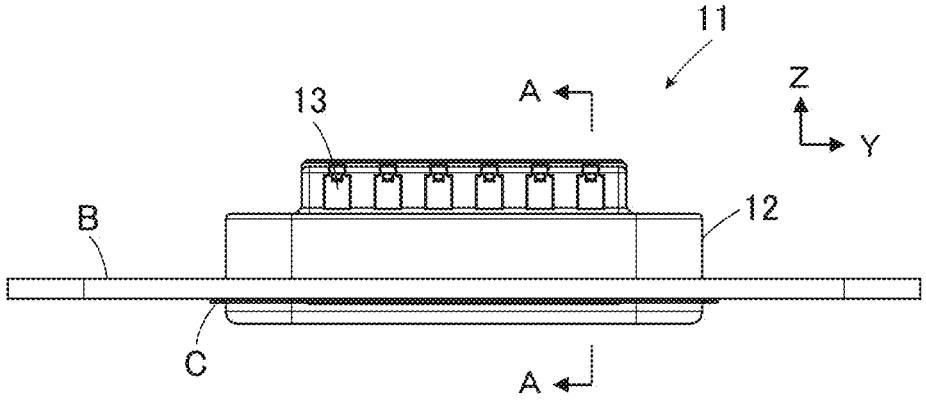
FIG. 3 is a front view of the connector according to Embodiment 1 attached to the connection object.

FIGS. 1 to 3 show a connector 11 according to Embodiment 1. The connector 11 is attached to a connection object C such as a flexible printed circuit (FPC) and used as a connector for fitting a wearable device. The connector 11 includes a connector body 12 made of an insulating material. The connection object C is, for instance, attached to a back side of a tab sheet B made of cloth. In the connector body 12, a plurality of contacts 13 are retained to project perpendicularly to the connection object C in two lines parallel to each other.

For convenience, the connection object C is defined as extending in an XY plane, the direction in which the contacts 13 are aligned is referred to as "Y direction," and the direction in which the contacts 13 project is referred to as "+Z direction."

Figure 4:
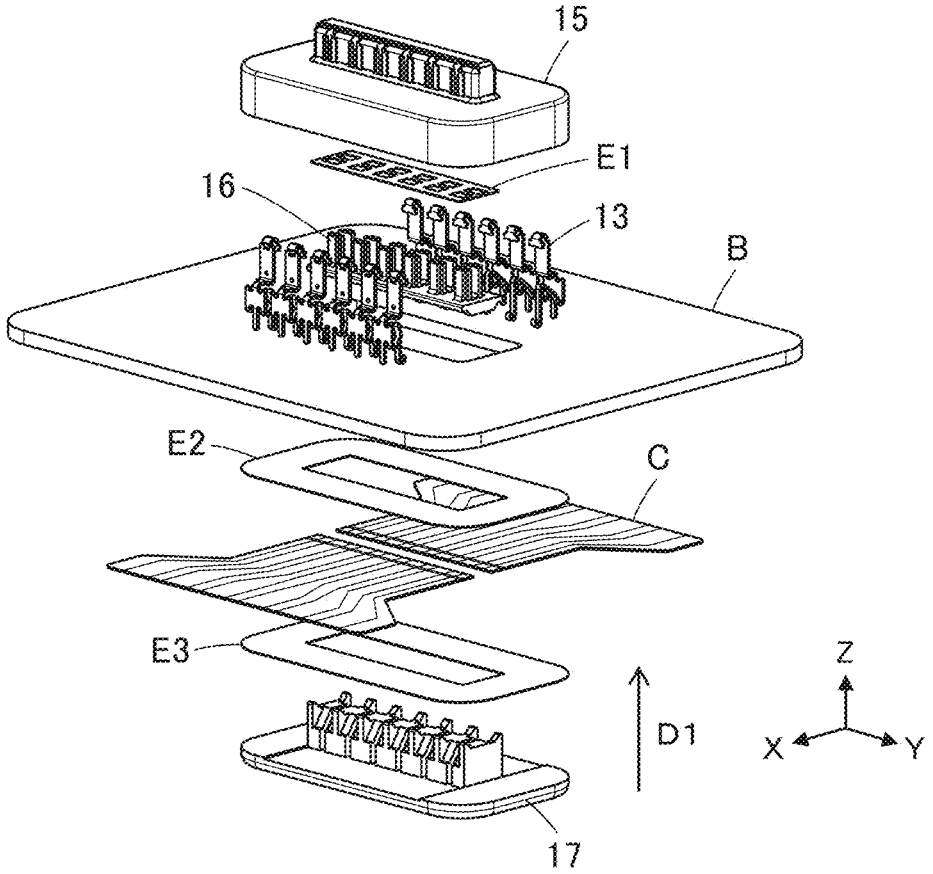
FIG. 4 is an exploded perspective view of the connector according to Embodiment 1.

FIG. 4 is an exploded perspective view of the connector 11. The connector 11 includes a first insulator 15, an inner insulator 16 and a second insulator 17, and these first insulator 15, inner insulator 16 and second insulator 17 constitute the connector body 12.

In the state where the contacts 13 are assembled with the first insulator 15, the inner insulator 16 is assembled to the first insulator 15 in the +Z direction which is a predetermined assembling direction D1. In this process, an adhesive sheet E1 is disposed between the first insulator 15 and the inner insulator 16. A part of each contact 13 is disposed between the first insulator 15 and the inner insulator 16, and the first insulator 15, the contacts 13 and the inner insulator 16 are bonded together by the adhesive sheet E1.

With the second insulator 17 and the first insulator 15 sandwiching the tab sheet B and the connection object C therebetween, the second insulator 17 is assembled to the first insulator 15 having the contacts 13 mounted thereon in the +Z direction which is the predetermined assembling direction D1. In this process, an adhesive sheet E2 is disposed between the tab sheet B and the connection object C, and an adhesive sheet E3 between the connection object C and the second insulator 17. The tab sheet B and the connection object C are bonded together by the adhesive sheet E2, and the connection object C and the second insulator 17 are bonded together by the adhesive sheet E3.

Figure 5:
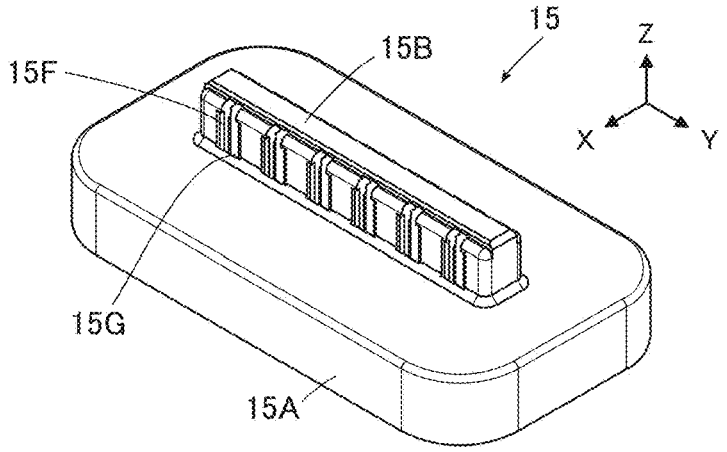
FIG. 5 is a perspective view of a first insulator used in the connector according to Embodiment 1, as viewed from an obliquely upper position.
Figure 6:
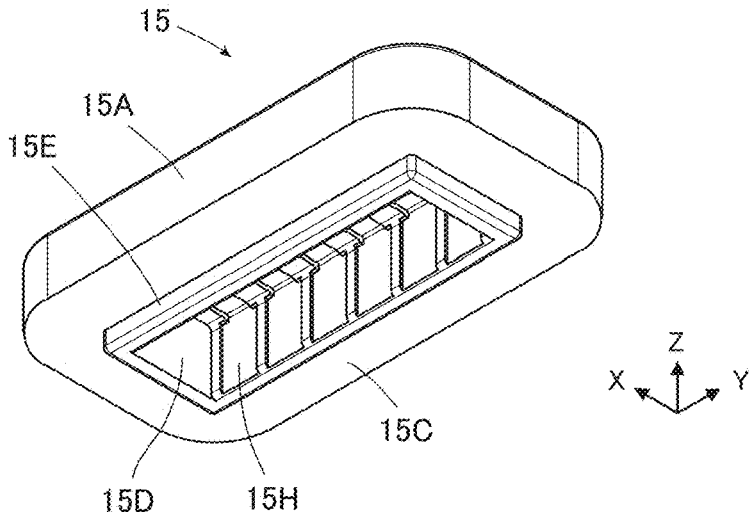
FIG. 6 is a perspective view of the first insulator used in the connector according to Embodiment 1, as viewed from an obliquely lower position.
Figure 7:
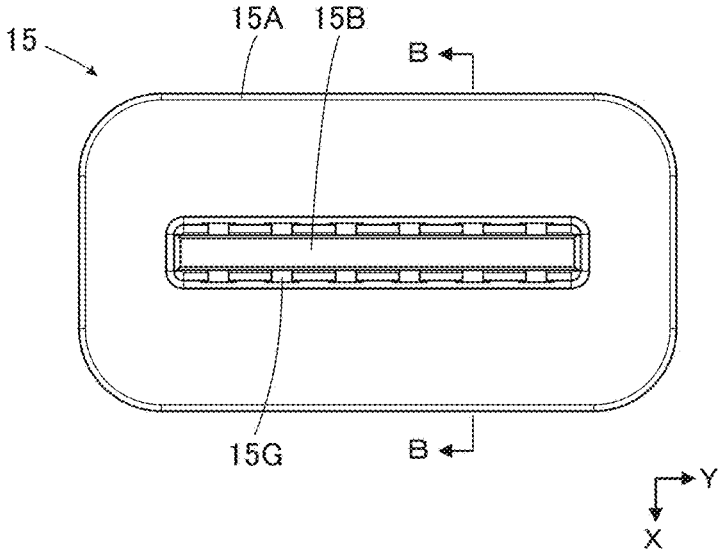
FIG. 7 is a top view of the first insulator used in the connector according to Embodiment 1.

As shown in FIGS. 5 to 7, the first insulator 15 includes a base portion 15A of flat plate shape extending in an XY plane and a projection portion 15B situated in the center of the base portion 15A and projecting in the +Z direction from the base portion 15A. The base portion 15A and the projection portion 15B each have a substantially rectangular outer shape with the long sides extending in the Y direction and the short sides extending in the X direction when viewed in the Z direction.

A recess portion 15D opening in the −Z direction is formed at a first surface 15C that is on the −Z direction side of the base portion 15A and is parallel to an XY plane, and a projection portion 15E projecting in the −Z direction is formed along the circumference of the recess portion 15D.

Figure 8:
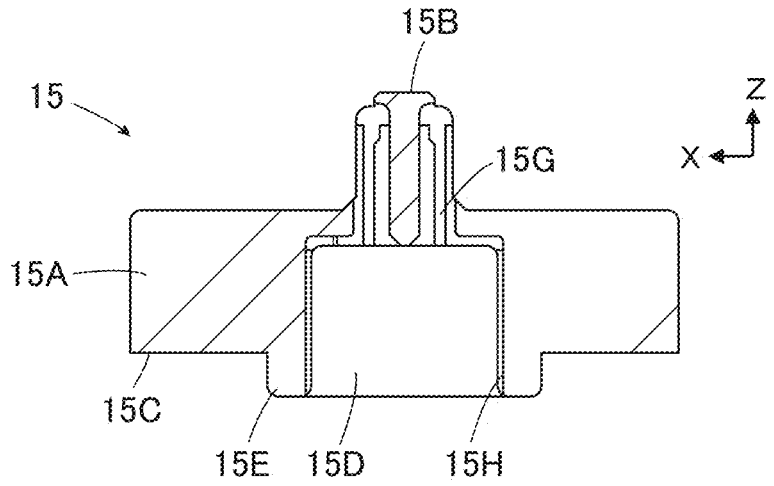
FIG. 8 is a cross-sectional view taken along line B-B in FIG. 7.

A plurality of retaining grooves 15F extending in the Z direction and used to retain the contacts 13 and the inner insulator 16 are formed at the opposite surfaces in the X direction of the projection portion 15B projecting in the +Z direction. A plurality of through-holes 15G are formed in the base portion 15A to penetrate from the surface of the base portion 15A on the +Z direction side up to the recess portion 15D in such a manner that the through-holes 15G correspond to the retaining grooves 15F on the opposite sides in the X direction. The recess portion 15D is provided with a plurality of retaining grooves 15H that are connected to the retaining grooves 15F via the through-holes 15G and used to retain the contacts 13. As shown in FIG. 8, the retaining grooves 15H extend in the X direction from the −Z directional ends of the through-holes 15G along the inner surface of the recess portion 15D and then extend in the −Z direction.

Figure 9:
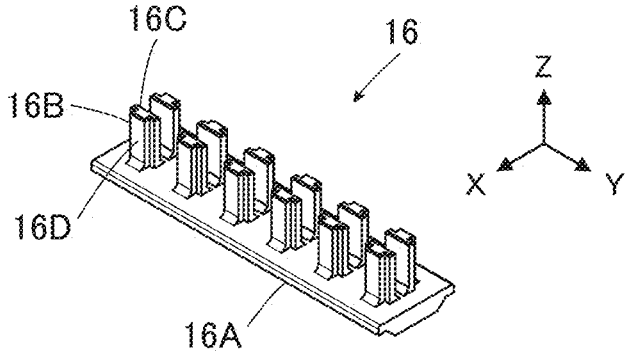
FIG. 9 is a perspective view of an inner insulator used in the connector according to Embodiment 1, as viewed from an obliquely upper position.
Figure 10:
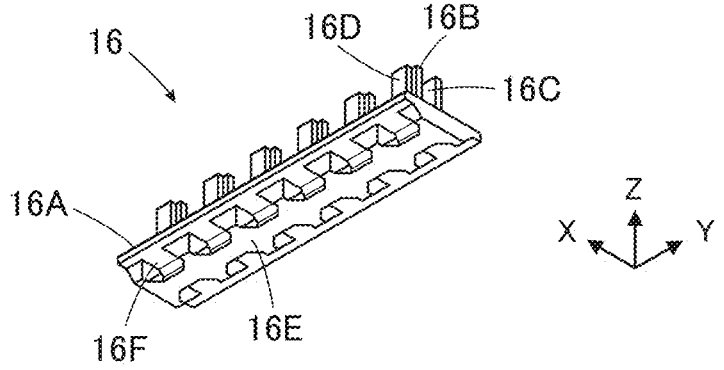
FIG. 10 is a perspective view of the inner insulator used in the connector according to Embodiment 1, as viewed from an obliquely lower position.

As shown in FIGS. 9 and 10, the inner insulator 16 includes a base portion 16A of flat plate shape extending in an XY plane and a plurality of protrusion portions 16B aligned in the Y direction in two lines parallel to each other in the center of the base portion 16A and protruding in the +Z direction from the base portion 16A. The base portion 16A has a substantially rectangular outer shape with the long sides extending in the Y direction and the short sides extending in the X direction when viewed in the Z direction. A part of the protrusion portions 16B situated on the +X direction side with respect to the center of the base portion 16A and the other part of the protrusion portions 16B situated on the −X direction side with respect to the center of the base portion 16A are symmetrical to each other in shape about a YZ plane passing through the center of the base portion 16A.

The protrusion portions 16B are to be inserted in the retaining grooves 15F of the first insulator 15, and each protrusion portion 16B has an inner surface 16C that faces the middle in the X direction of the base portion 16A and is parallel to a YZ plane and an outer surface 16D that faces the outside in the X direction of the base portion 16A and is parallel to a YZ plane.

A projection portion 16E projecting in the −Z direction and extending in the Y direction is formed on the surface of the base portion 16A on the −Z direction side. A plurality of recess portions 16F are formed in the projection portion 16E at positions corresponding to the retaining grooves 15F of the first insulator 15 shown in FIG. 5.

Figure 11:
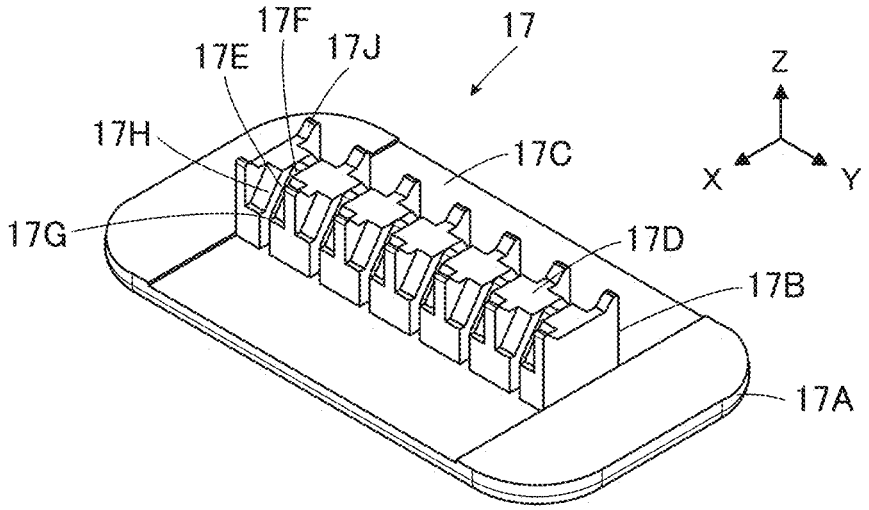
FIG. 11 is a perspective view of a second insulator used in the connector according to Embodiment 1, as viewed from an obliquely upper position.
Figure 12:
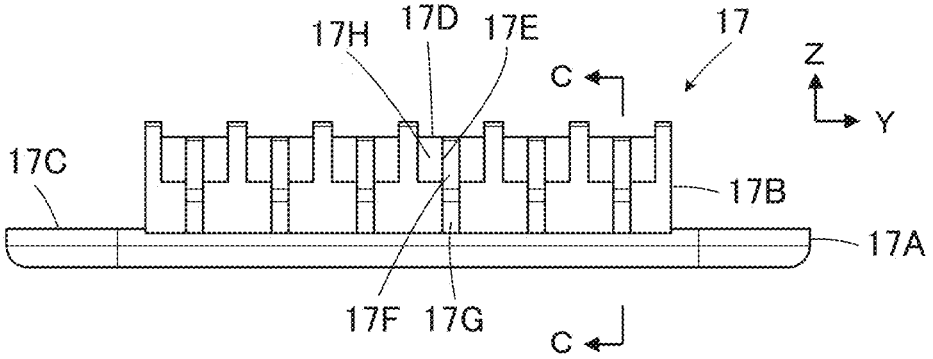
FIG. 12 is a front view of the second insulator used in the connector according to Embodiment 1.
Figure 13:
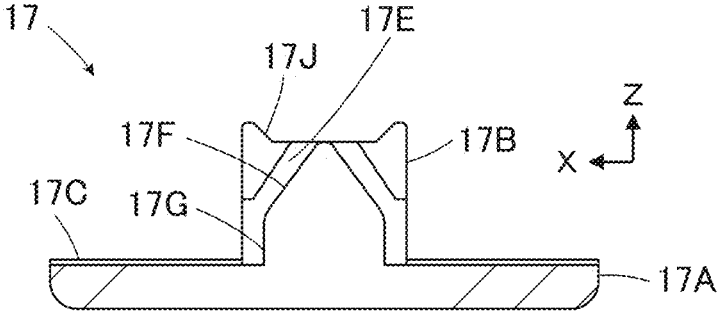
FIG. 13 is a cross-sectional view taken along line C-C in FIG. 12.

As shown in FIGS. 11 to 13, the second insulator 17 includes a base portion 17A of flat plate shape extending in an XY plane and a convex portion 17B situated in the center of the base portion 17A and projecting in the +Z direction from the base portion 17A. The base portion 17A is provided with a second surface 17C facing in the +Z direction and being parallel to an XY plane. The base portion 17A and the convex portion 17B each have a substantially rectangular outer shape with the long sides extending in the Y direction and the short sides extending in the X direction when viewed in the Z direction.

The convex portion 17B is to be inserted in the recess portion 15D of the first insulator 15 and has a size slightly smaller than that of the recess portion 15D in an XY plane.

The convex portion 17B is provided with a top surface 17D parallel to an XY plane. A plurality of grooves 17E are formed at the top surface 17D and the opposite lateral surfaces in the X direction of the convex portion 17B to extend up to the second surface 17C while being inclined to the Z direction.

Each groove 17E on the +X direction side is provided on its bottom with a guide surface 17F that is inclined to the Z direction to face in the +X direction and the +Z direction and a pressing force applying surface 17G that is adjacent to the −Z direction side of the guide surface 17F and extends in a YZ plane.

On the +X direction side of the convex portion 17B, inclined surfaces 17H inclined to the Z direction in the same manner as the guide surfaces 17F are formed on the opposite sides in the Y direction of each groove 17E, and there are formed a plurality of connection object bending portions 17J that are adjacent to the inclined surfaces 17H in the Y direction, are situated on the +Z direction side beyond the top surface 17D and have surfaces facing in the +Z direction.

Each groove 17E on the −X direction side is provided on its bottom with a guide surface 17F and a pressing force applying surface 17G that are symmetrical to the guide surface 17F and the pressing force applying surface 17G on the +X direction side in shape about a YZ plane. On the −X direction side of the convex portion 17B, a plurality of inclined surfaces 17H and a plurality of connection object bending portions 17J are formed in the same manner as on the +X direction side.

Figure 14:
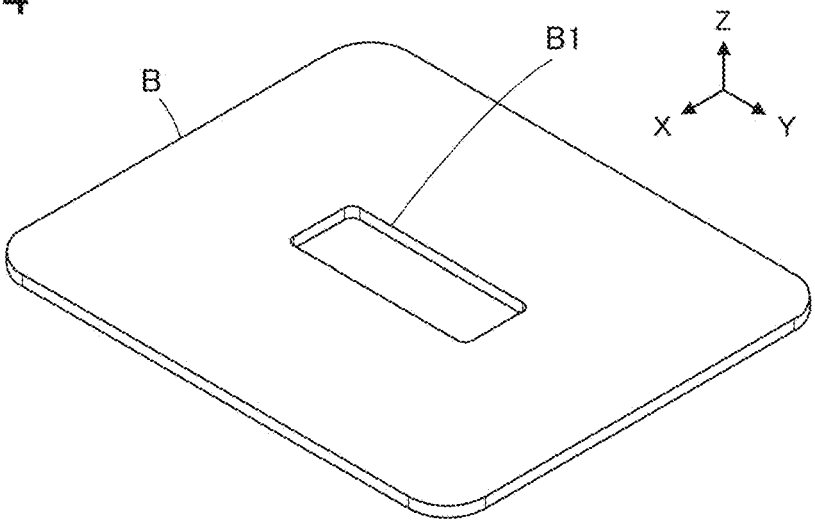
FIG. 14 is a perspective view of a tab sheet used in the connector according to Embodiment 1, as viewed from an obliquely upper position.

As shown in FIG. 14, the tab sheet B is made of, for instance, cloth of a garment, and the connection object C and the connector 11 are to be attached to the tab sheet B. The tab sheet B has a larger size than that of the base portion 15A of the first insulator 15 and that of the base portion 17A of the second insulator 17 in an XY plane.

The tab sheet B is provided at its center with a substantially rectangular opening B1 with the long sides extending in the Y direction and the short sides extending in the X direction. A part of the tab sheet B around the opening B1 is to be sandwiched together with the connection object C between the base portion 15A of the first insulator 15 and the base portion 17A of the second insulator 17 when the connector 11 is attached to the connection object C, and in this process, the projection portion 15E extending along the circumference of the recess portion 15D on the first surface 15C of the base portion 15A of the first insulator 15 is inserted into the opening B1.

Figure 15:
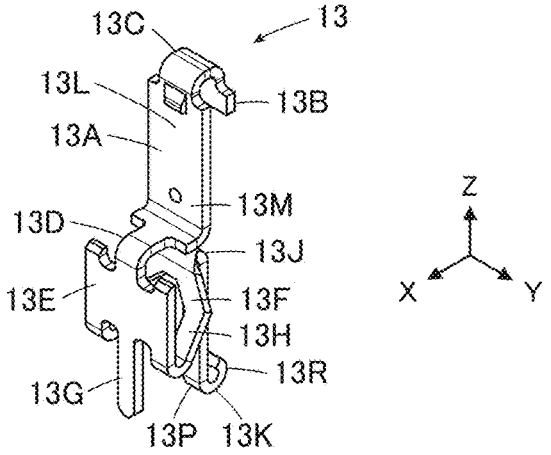
FIG. 15 is a perspective view of a contact used in the connector according to Embodiment 1, as viewed from the anterior side (front side).
Figure 16:
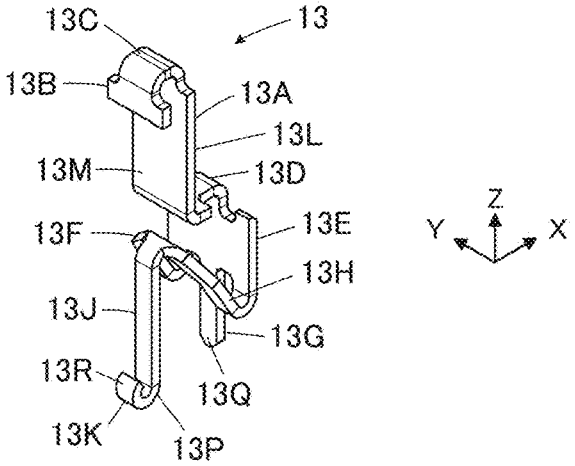
FIG. 16 is a perspective view of the contact used in the connector according to Embodiment 1, as viewed from the posterior side (back side).
Figure 17:
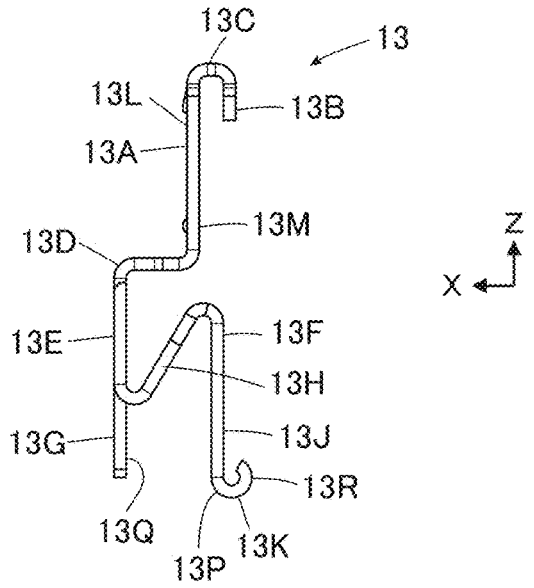
FIG. 17 is a side view of the contact used in the connector according to Embodiment 1.

FIGS. 15 to 17 show the structure of the contact 13 to be retained in the retaining groove 15F on, of the opposite sides in the X direction, the +X direction side of the projection portion 15B of the first insulator 15 shown in FIG. 5.

The contact 13 is constituted of a band-like member made of a conductive material such as metal and includes a first flat plate portion 13A extending in a YZ plane, a fixing portion 13B extending in a YZ plane, being situated on the −X direction side of the first flat plate portion 13A and being shorter than the first flat plate portion 13A in the Z direction, and a joint portion 13C joining the +Z directional ends of the first flat plate portion 13A and the fixing portion 13B together. A second flat plate portion 13E extending in a YZ plane is connected via a step portion 13D to the −Z directional end of the first flat plate portion 13A.

The contact 13 further includes a first arm portion 13F and a second arm portion 13G. The first arm portion 13F has a forked portion 13H that extends from two portions at the opposite ends in the Y direction of the −Z directional end of the second flat plate portion 13E, is bent toward the −X direction and the +Z direction and then extends in a direction inclined to the Z direction and an extension portion 13J that extends in the −Z direction from the +Z directional end of the forked portion 13H. The second arm portion 13G extends in the −Z direction from the middle portion in the Y direction of the −Z directional end of the second flat plate portion 13E. The −Z directional end of the extension portion 13J forms a free end and is provided with a curved portion 13K curved to be rounded on the −X direction side.

The surface of the first flat plate portion 13A on the +X direction side forms a contact portion 13L that is to make contact with a contact of a counter connector (not shown). A portion of the first flat plate portion 13A on the −Z direction side, the step portion 13D and the second flat plate portion 13E constitute a retained portion 13M to be retained between the first insulator 15 and the second insulator 17. Thus, the retained portion 13M is connected at its one end with the contact portion 13L and at its other end with the first arm portion 13F and the second arm portion 13G.

The surface of the curved portion 13K of the first arm portion 13F on the +X direction side forms a first connection portion 13P that is to make contact with one surface of the connection object C. The surface of the second arm portion 13G on the −X direction side forms a second connection portion 13Q that is to make contact with the other surface of the connection object C. Thus, the first connection portion 13P and the second connection portion 13Q face each other in the X direction.

The surface of the curved portion 13K of the first arm portion 13F on the −X direction side forms a pressing force receiving portion 13R that is to receive a pressing force from the pressing force applying surface 17G of the second insulator 17 shown in FIG. 13 and consequently press the first connection portion 13P against the second connection portion 13Q when the second insulator 17 is assembled to the first insulator 15. The pressing force receiving portion 13R is disposed at the curved portion 13K to face the opposite side from the second connection portion 13Q with respect to the first connection portion 13P.

Note that the contacts 13 to be retained in the retaining grooves 15F on, of the opposite sides in the X direction, the −X direction side of the projection portion 15B of the first insulator 15 shown in FIG. 5 have the same structure as that of the contact 13 shown in FIGS. 15 to 17 but are placed in the opposite orientation therefrom in the X direction.

Figure 18:
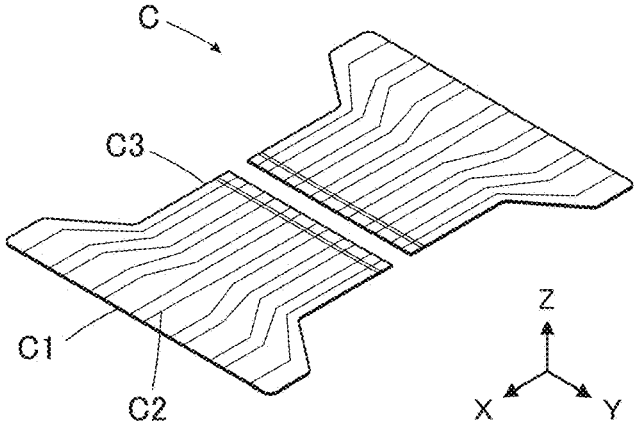
FIG. 18 is a perspective view of the connection object to which the connector according to Embodiment 1 is to be attached, as viewed from an obliquely upper position.
Figure 19:
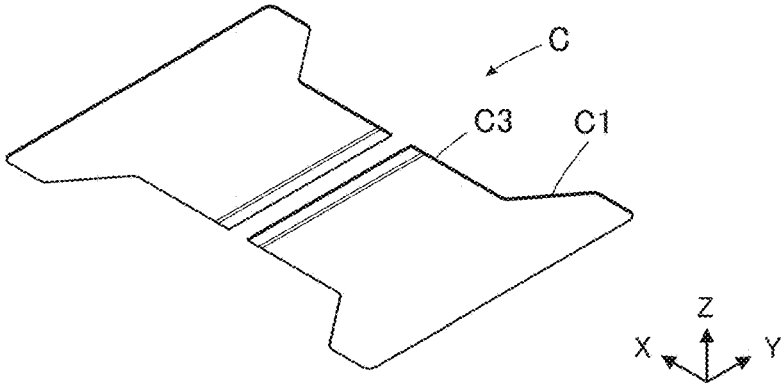
FIG. 19 is a perspective view of the connection object to which the connector according to Embodiment 1 is to be attached, as viewed from an obliquely lower position.

For the connection object C to which the connector 11 is attached, applicable examples include: a so-called smart textile provided on its one surface with wiring formed by weaving of conductive fibers into the textile, printing of conductive ink, or another method; and a flexible printed circuit. In the connection object C shown in FIG. 18, wiring made of a plurality of flexible conductors C2 is exposed on the top surface, which faces in the +Z direction, of a substrate C1 made of an insulating material and having flexibility. As shown in FIG. 19, the flexible conductors C2 are not exposed on the bottom surface, which faces in the −Z direction, of the substrate C1.

The connection object C has tip portions C3 whose width in the Y direction is slightly smaller than the width in the Y direction of the opening B1 of the tab sheet B shown in FIG. 14.

Attachment of the connector 11 to the connection object C is described below.

Figure 20:
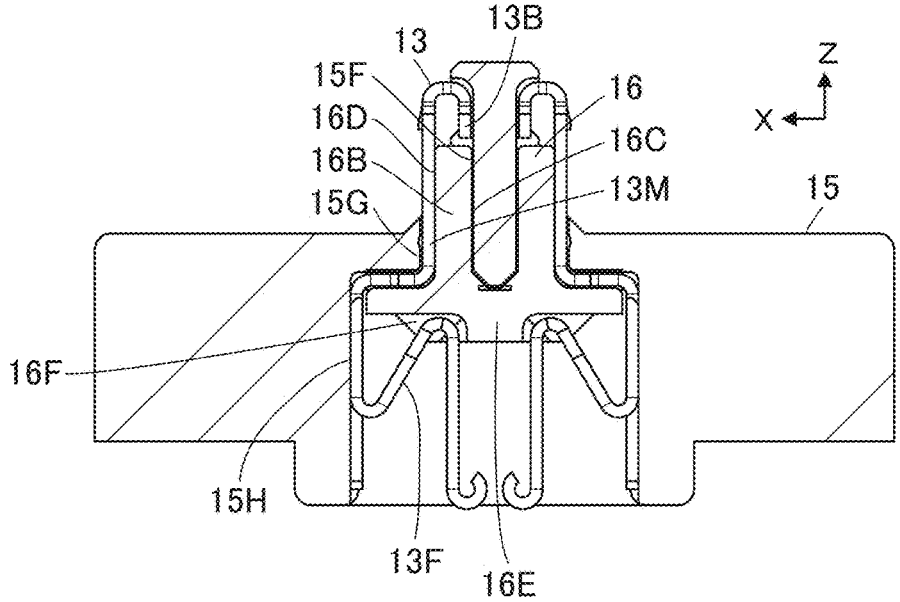
FIG. 20 is a cross-sectional view showing an assembly of the first insulator, the inner insulator and the contact in Embodiment 1.

First, as shown in FIG. 20, the contacts 13 are inserted into the through-holes 15G of the first insulator 15 from the −Z direction side and then placed along the retaining grooves 15F of the projection portion 15B projecting in the +Z direction and the retaining grooves 15H of the recess portion 15D. In this process, the fixing portion 13B of the contact 13 is fixed to the +Z directional end of the retaining groove 15F. The +Z directional end of the first arm portion 13F of the contact 13 is situated within the recess portion 16F formed in the projection portion 16E of the inner insulator 16 without contact with the inner insulator 16.

In this state, the protrusion portions 16B of the inner insulator 16 are inserted into the through-holes 15G of the first insulator 15 having the adhesive sheet E1 attached thereto. In this process, the protrusion portion 16B is inserted into the through-hole 15G of the first insulator 15 such that the inner surface 16C faces the retaining groove 15F of the first insulator 15 and the outer surface 16D faces the contact 13. Thus, the retained portion 13M of the contact 13 is disposed between the first insulator 15 and the inner insulator 16.

Figure 21:
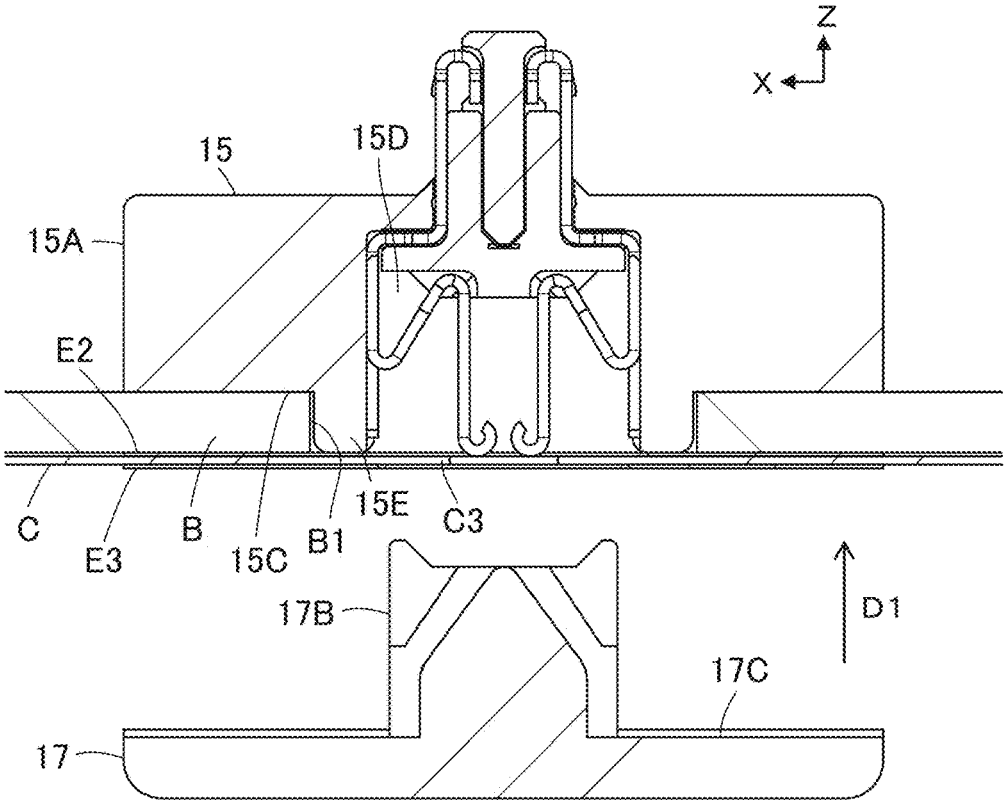
FIG. 21 is a view showing the state where the second insulator is positioned with respect to the assembly.

Next, as shown in FIG. 21, the projection portion 15E formed on the first surface 15C of the base portion 15A of the first insulator 15 is inserted into the opening B1 of the tab sheet B, and the connection object C is disposed on the surface of the tab sheet B on the −Z direction side via the adhesive sheet E2. In this process, the connection object C is disposed such that the tip portions C3 are situated inside the opening B1 of the tab sheet B when viewed in the Z direction. The adhesive sheet E3 is disposed on the surface of the connection object C on the −Z direction side. In this state, the second insulator 17 is positioned with respect to the first insulator 15 such that the convex portion 17B of the second insulator 17 is aligned with the recess portion 15D of the first insulator 15 along the predetermined assembling direction D1, i.e., the +Z direction.

Figure 22:
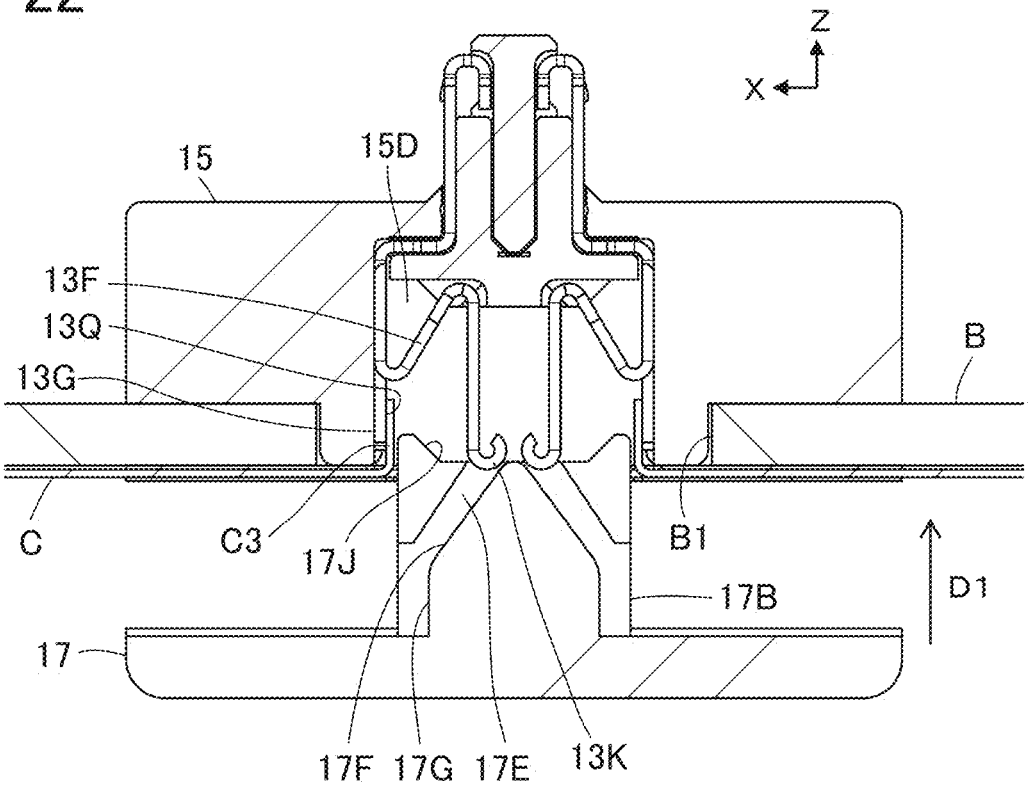
FIG. 22 is a view showing the state where assembling of the second insulator to the first insulator is started.

The thus positioned second insulator 17 is linearly moved toward the first insulator 15 in the +Z direction. Assembling of the second insulator 17 to the first insulator 15 is thus started as shown in FIG. 22.

In the state where the convex portion 17B of the second insulator 17 is inserted in the recess portion 15D of the first insulator 15, there is a gap slightly wider than the thickness of the connection object C between the convex portion 17B of the second insulator 17 and a surface of the second connection portion 13Q of the contact 13. Accordingly, as the second insulator 17 is inserted into the first insulator 15 in the +Z direction, the tip portions C3 of the connection object C situated inside the opening B1 of the tab sheet B when viewed in the Z direction are bent toward the +Z direction by the connection object bending portions 17J of the second insulator 17. This allows surfaces of the tip portions C3 of the connection object C to face the second connection portions 13Q of the contacts 13. Since a worker who assembles the connector 11 need not manually bend the tip portions C3 of the connection object C, the worker can easily assemble the connector 11.

The curved portion 13K of the contact 13 is inserted into the groove 17E of the second insulator 17, and as the second insulator 17 is moved toward the first insulator 15 in the +Z direction, the curved portion 13K is pushed by the guide surface 17F of the second insulator 17 and thereby displaced in the X direction to approach the second arm portion 13G. When the second insulator 17 is further moved in the +Z direction, the curved portion 13K of the first arm portion 13F reaches the −Z directional end of the guide surface 17F and thereafter keeps its contact with the pressing force applying surface 17G.

Figure 23:
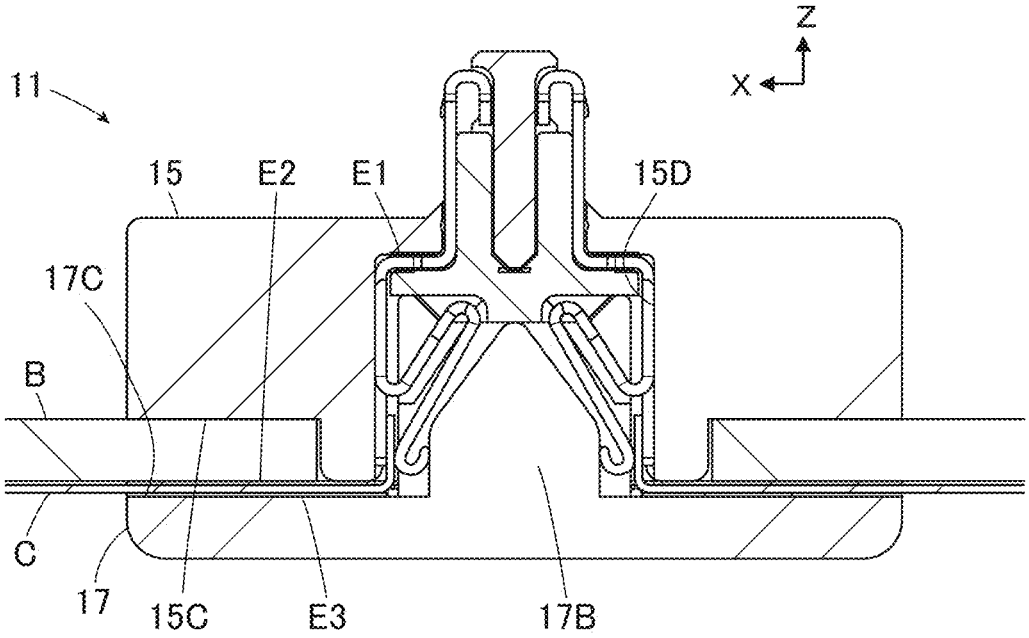
FIG. 23 is a cross-sectional view taken along line A-A in FIG. 3.

As shown in FIG. 23, the second insulator 17 is moved in the +Z direction until the connection object C is sandwiched between the first surface 15C of the first insulator 15 and the second surface 17C of the second insulator 17 and also the convex portion 17B of the second insulator 17 is totally accommodated in the recess portion 15D of the first insulator 15, whereby the second insulator 17 is assembled to the first insulator 15.

Finally, by heating the adhesive sheets E1, E2 and E3, the first insulator 15, the inner insulator 16 and the contacts 13 are bonded together, the tab sheet B and the connection object C are bonded together, and the connection object C and the second insulator 17 are bonded together.

Attachment of the connector 11 to the connection object C is thus completed.

Figure 24:
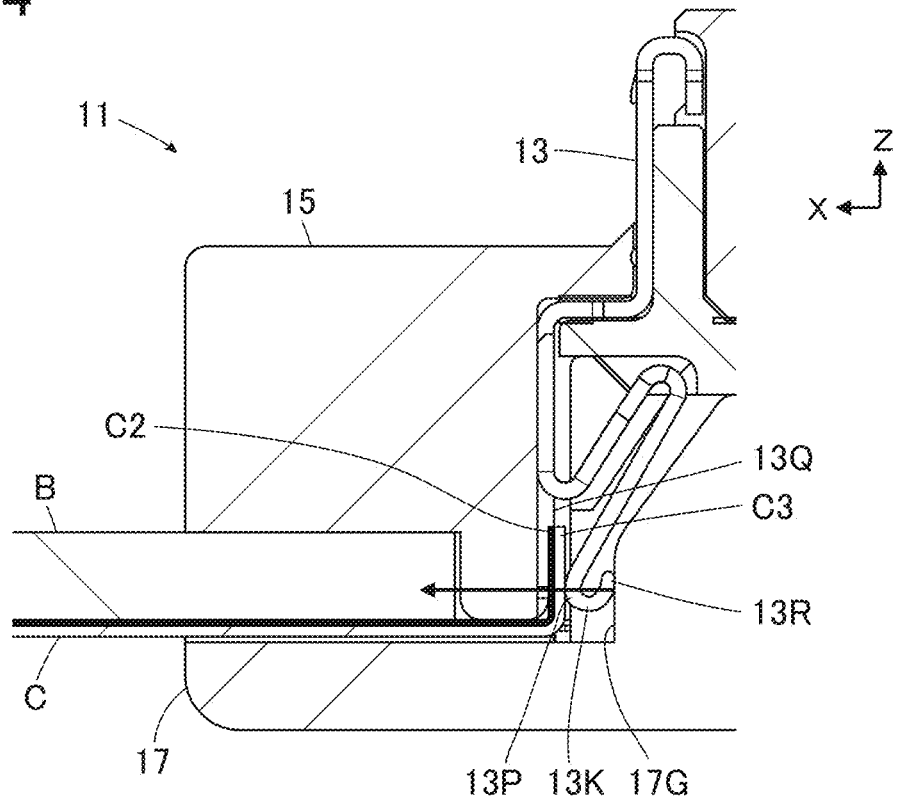
FIG. 24 is an enlarged view of an important part of FIG. 23.

As shown in FIG. 24, in the connector 11, the pressing force receiving portion 13R of the curved portion 13K of the contact 13 situated on the +X direction side receives a pressing force acting in the +X direction from the pressing force applying surface 17G of the second insulator 17, whereby the first connection portion 13P of the curved portion 13K is pressed against the tip portion C3 of the connection object C. Accordingly, the tip portion C3 of the connection object C is sandwiched between the first connection portion 13P and the second connection portion 13Q of the contact 13. Since the flexible conductors C2 of the connection object C are exposed on the surface of the substrate C1 on the second connection portion 13Q side in the tip portion C3, the flexible conductors C2 make contact with the second connection portion 13Q. Thus, the flexible conductors C2 of the connection object C are electrically connected to the contact 13 via the second connection portion 13Q.

Further, the pressing force receiving portion 13R of the curved portion 13K of the contact 13 situated on the −X direction side receives a pressing force acting in the −X direction from the pressing force applying surface 17G of the second insulator 17. Consequently, the first connection portion 13P is pressed against the tip portion C3 of the connection object C, so that the tip portion C3 of the connection object C is sandwiched between the first connection portion 13P and the second connection portion −13Q of the contact 13. Thus, the contact 13 situated on the −X direction side is also electrically connected to the flexible conductors C2 of the connection object C in the same manner as the contact 13 situated on the +X direction side.

As described above, in the connector 11 according to Embodiment 1 of the invention, the opposite surfaces of the connection object C are sandwiched between the first connection portion 13P and the second connection portion 13Q of the contact 13; therefore, for instance, even when the flexible conductors C2 are exposed on, of the opposite surfaces, either surface of the substrate C1, the corresponding one of the first connection portion 13P and the second connection portion 13Q makes contact with the flexible conductors C2, thus establishing a reliable electrical connection between the flexible conductors C2 and the contact 13.

When, for example, the flexible conductors C2 are exposed on the opposite surfaces of the substrate C1, both the first connection portion 13P and the second connection portion 13Q make contact with the flexible conductors C2. This configuration increases the contact area between the flexible conductors C2 and the contact 13 and is therefore effective when a value of current flowing between the flexible conductors C2 and the contact 13 is large.

Further, even if a poor contact occurs at one of the first connection portion 13P and the second connection portion 13Q with respect to the flexible conductors C2, the contact 13 can be electrically connected to the flexible conductors C2 through the other of the first connection portion 13P and the second connection portion 13Q.

Aside from that, as shown in FIG. 22, when the convex portion 17B of the second insulator 17 is inserted into the recess portion 15D of the first insulator 15, a gap wider in the X direction than the thickness of the connection object C is formed between the surface of the second connection portion 13Q of the contact 13 and the surface of the convex portion 17B; therefore, the connection object C does not receive a pressing force acting in the X direction from the convex portion 17B of the second insulator 17 before being sandwiched between the first connection portion 13P and the second connection portion 13Q of the contact 13. This configuration makes it possible to prevent the connection object C from being scratched by the second insulator 17 in making an electrical connection between the flexible conductors C2 and the contact 13. In the connector 11 according to Embodiment 1 of the invention, the reliability of electrical connection between the flexible conductors C2 of the connection object C and the contact 13 is improved also from this point of view.

Furthermore, the connection object C receives a force acting in the X direction perpendicular to the +Z direction, which is the predetermined assembling direction D1, from the first connection portion 13P and the second connection portion 13Q of the contact 13; therefore, it is unlikely that the second insulator 17 assembled with the first insulator 15 is separated from the first insulator 15 due to the force to sandwich the connection object C by the first and second connection portions 13P and 13Q of the contact 13, thus making it possible to maintain the connector 11 in a stable state. The direction in which the first connection portion 13P and the second connection portion 13Q sandwich the connection object C therebetween need not necessarily be perpendicular to the predetermined assembling direction D1 but preferably crosses the predetermined assembling direction D1.

The first insulator 15, the contacts 13 and the inner insulator 16 are bonded together by the adhesive sheet E1, and this prevents liquid such as water from infiltrating into the through-holes 15G of the first insulator 15 from, for instance, the +Z direction side of the first insulator 15.

The contact 13 may be made of a conductive material having no elasticity as long as it is a conductive material that is bendable without being broken.

Embodiment 2

Figure 25:
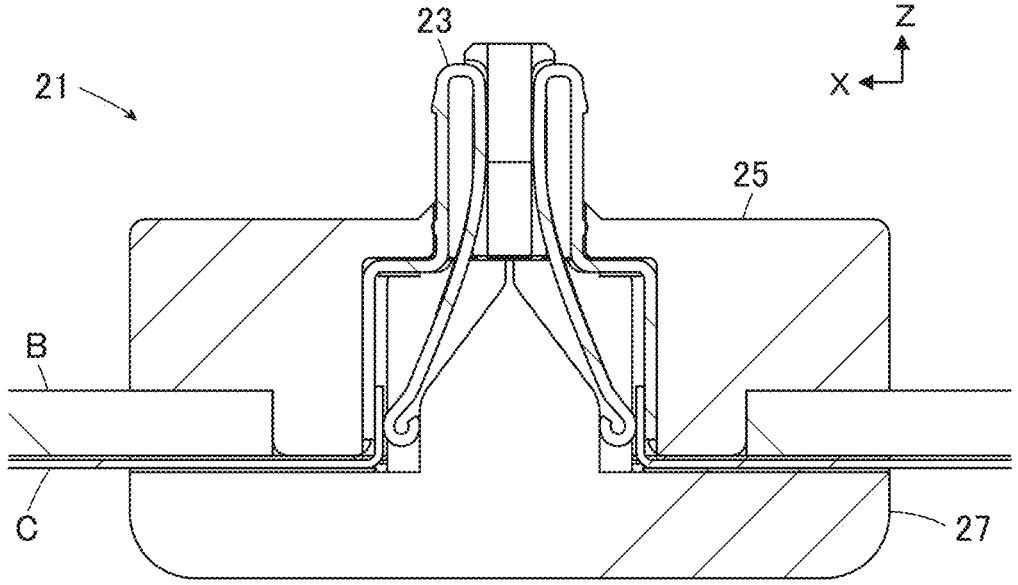
FIG. 25 is a cross-sectional view of the structure of a connector according to Embodiment 2.

FIG. 25 shows a connector 21 according to Embodiment 2 attached to the connection object C. The connector 21 includes a first insulator 25, a second insulator 27, and a plurality of contacts 23 retained by these first insulator 25 and second insulator 27. The contacts 23 are retained to project perpendicularly to the connection object C in two lines parallel to each other.

For convenience, the connection object C is defined as extending in an XY plane, the direction in which the contacts 23 are aligned is referred to as "Y direction," and the direction in which the contacts 23 project is referred to as "+Z direction" as with Embodiment 1.

Figure 26:
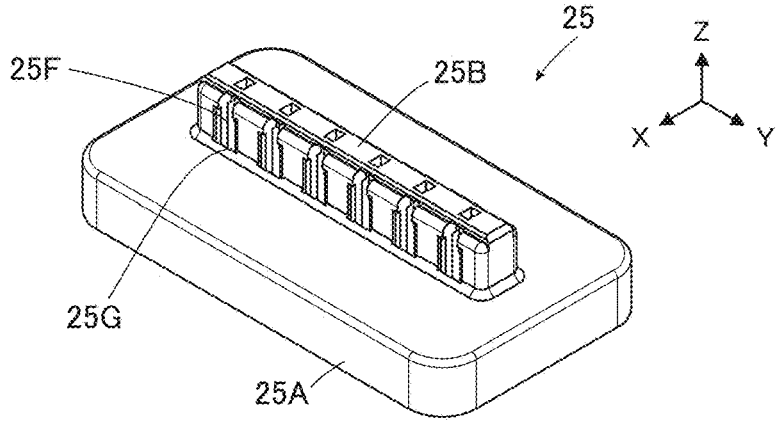
FIG. 26 is a perspective view of a first insulator used in the connector according to Embodiment 2, as viewed from an obliquely upper position.
Figure 27:
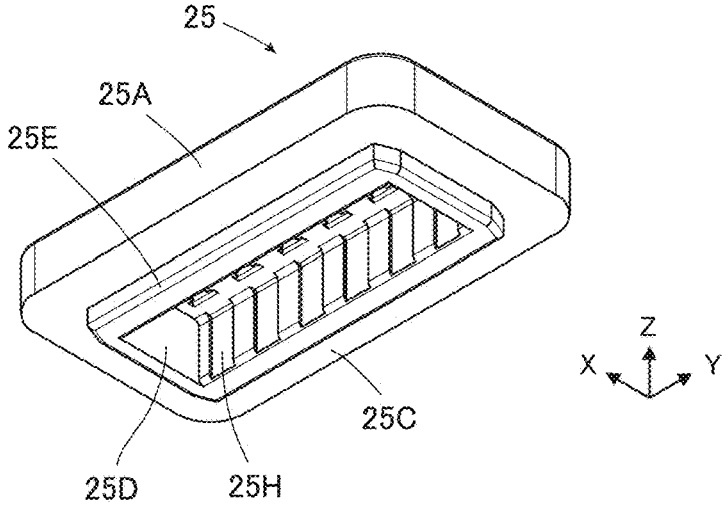
FIG. 27 is a perspective view of the first insulator used in the connector according to Embodiment 2, as viewed from an obliquely lower position.
Figure 28:
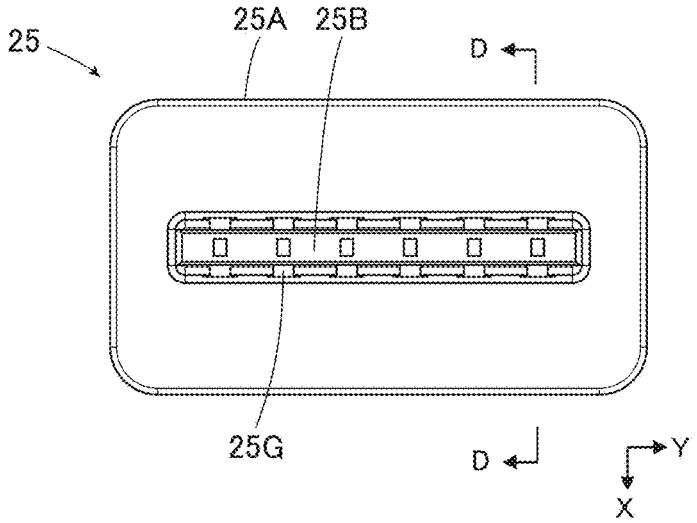
FIG. 28 is a top view of the first insulator used in the connector according to Embodiment 2.

As shown in FIGS. 26 to 28, the first insulator 25 includes a base portion 25A extending in an XY plane and a projection portion 25B situated in the center of the base portion 25A and projecting in the +Z direction from the base portion 25A. The base portion 25A and the projection portion 25B each have a substantially rectangular shape with the long sides extending in the Y direction and the short sides extending in the X direction when viewed in the Z direction.

A recess portion 25D opening in the −Z direction is formed at a first surface 25C that is on the −Z direction side of the base portion 25A and is parallel to an XY plane, and a projection portion 25E projecting in the −Z direction is formed along the circumference of the recess portion 25D.

Figure 29:
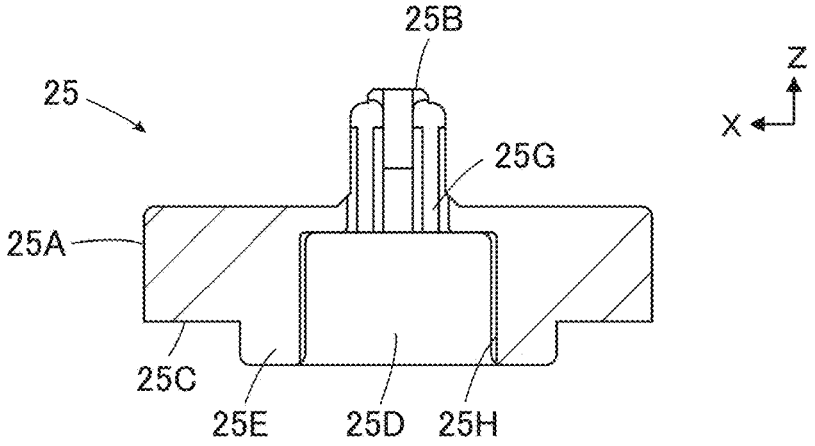
FIG. 29 is a cross-sectional view taken along line D-D in FIG. 28.

A plurality of retaining grooves 25F extending in the Z direction and used to retain the contacts 23 are formed at the opposite surfaces in the X direction of the projection portion 25B projecting in the +Z direction. A plurality of through-holes 25G are formed in the base portion 25A to penetrate from the surface of the base portion 25A on the +Z direction side up to the recess portion 25D in such a manner that the through-holes 25G correspond to the retaining grooves 25F on the opposite sides in the X direction. The recess portion 25D is provided with a plurality of retaining grooves 25H that are connected to the retaining grooves 25F via the through-holes 25G and used to retain the contacts 23. As shown in FIG. 29, the retaining grooves 25H extend in the X direction from the −Z directional ends of the through-holes 25G along the inner surface of the recess portion 25D and then extend in the −Z direction.

Figure 30:
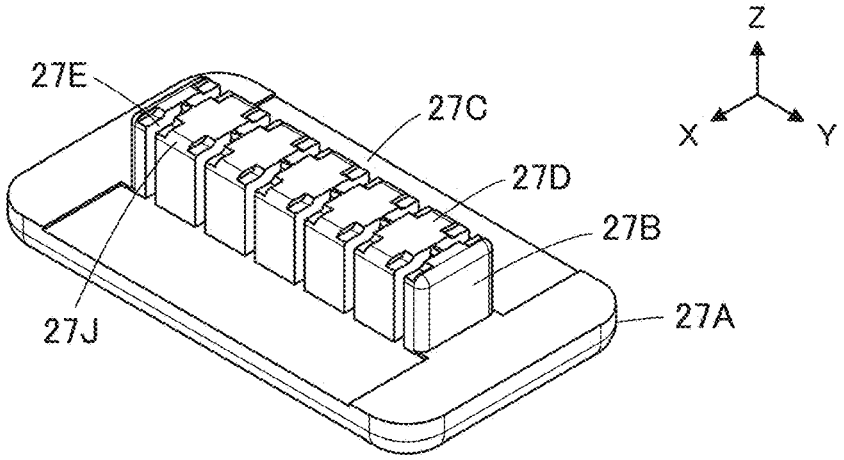
FIG. 30 is a perspective view of a second insulator used in the connector according to Embodiment 2, as viewed from an obliquely upper position.
Figure 31:
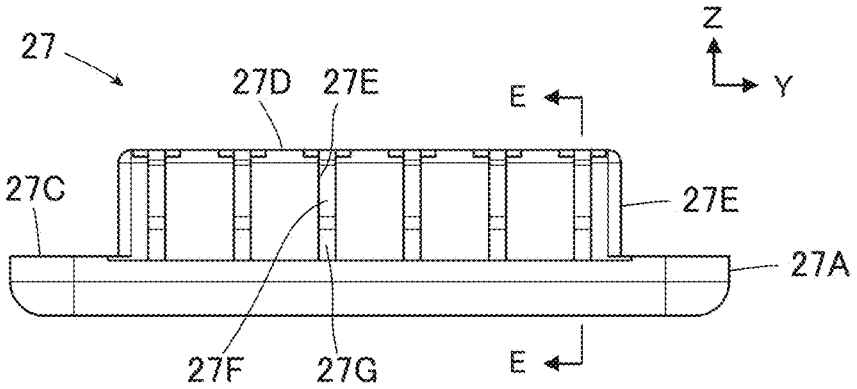
FIG. 31 is a front view of the second insulator used in the connector according to Embodiment 2.
Figure 32:
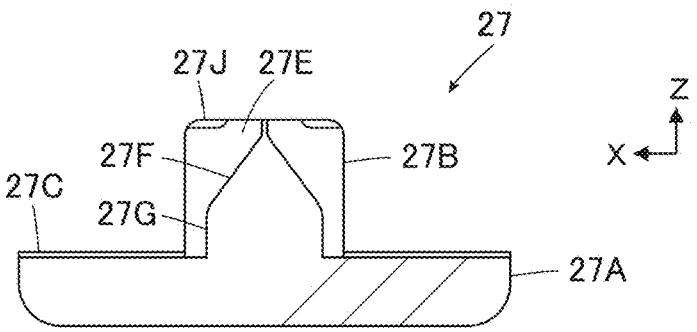
FIG. 32 is a cross-sectional view taken along line E-E in FIG. 31.

As shown in FIGS. 30 to 32, the second insulator 27 includes a base portion 27A of flat plate shape extending in an XY plane and a convex portion 27B situated in the center of the base portion 27A and projecting in the +Z direction from the base portion 27A. The base portion 27A is provided with a second surface 27C facing in the +Z direction and parallel to an XY plane. The base portion 27A and the convex portion 27B each have a substantially rectangular outer shape with the long sides extending in the Y direction and the short sides extending in the X direction when viewed in the Z direction.

The convex portion 27B is to be inserted in the recess portion 25D of the first insulator 25 and has a size slightly smaller than that of the recess portion 25D in an XY plane.

The convex portion 27B is provided with a top surface 27D parallel to an XY plane. A plurality of grooves 27E are formed at the top surface 27D and the opposite lateral surfaces in the X direction of the convex portion 27B to extend up to the second surface 27C while being inclined to the Z direction.

Each groove 27E on the +X direction side is provided on its bottom with a guide surface 27F that is inclined to the Z direction to face in the +X direction and +Z direction and a pressing force applying surface 27G that is adjacent to the −Z direction side of the guide surface 27F and extends in a YZ plane.

A connection object bending portion 27J is formed from the +X directional end of the top surface 27D at a position between two adjacent grooves 27E.

Each groove 27E on the −X direction side is provided on its bottom with a guide surface 27F and a pressing force applying surface 27G that are symmetrical to the guide surface 27F and the pressing force applying surface 27G on the +X direction side in shape about a YZ plane. In addition, a connection object bending portion 27J is formed from the −X directional end of the top surface 27D at a position between two adjacent grooves 27E in the same manner as at the +X directional end of the top surface 27D.

Figure 33:
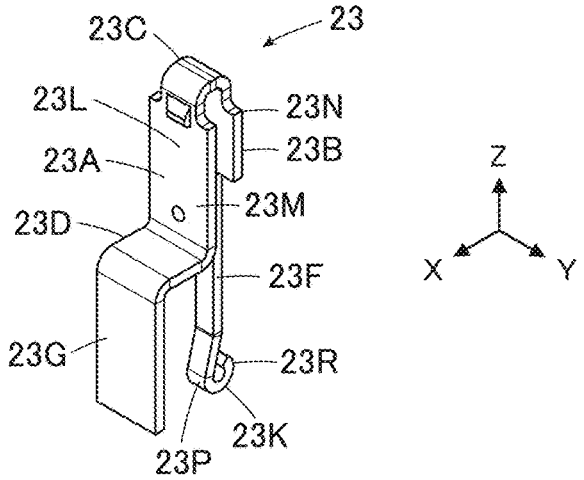
FIG. 33 is a perspective view of a contact used in the connector according to Embodiment 2, as viewed from the anterior side (front side).
Figure 34:
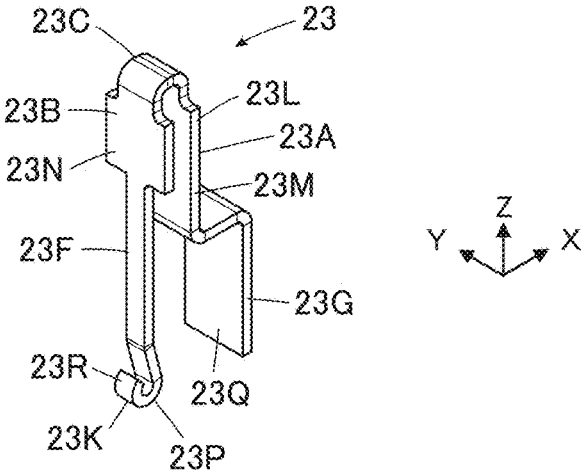
FIG. 34 is a perspective view of the contact used in the connector according to Embodiment 2, as viewed from the posterior side (back side).
Figure 35:
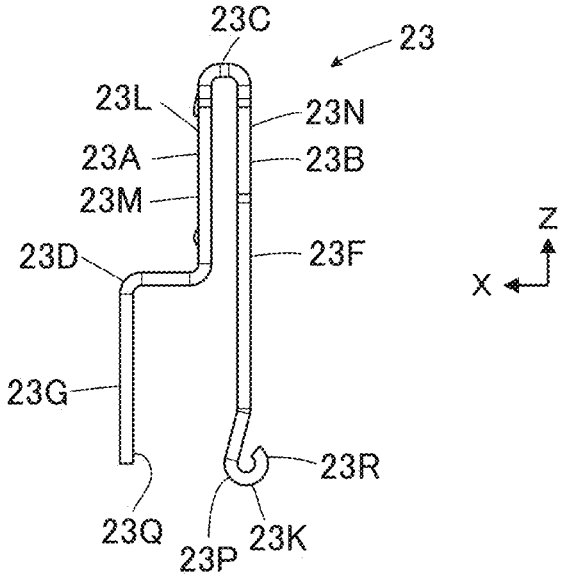
FIG. 35 is a side view of the contact used in the connector according to Embodiment 2.

FIGS. 33 to 35 show the structure of the contact 23 to be retained in the retaining groove 25F on, of the opposite sides in the X direction, the +X direction side of the projection portion 25B of the first insulator 25 shown in FIG. 26.

The contact 23 is constituted of a band-like member made of a conductive material such as metal and includes a first flat plate portion 23A extending in a YZ plane, a fixing portion 23B extending in a YZ plane and being situated on the −X direction side of the first flat plate portion 23A, and a joint portion 23C joining the +Z directional ends of the first flat plate portion 23A and the fixing portion 23B together. The contact 23 further includes a first arm portion 23F being joined to the −Z directional end of the fixing portion 23B and extending in the −Z direction therefrom and a second arm portion 23G of flat plate shape being joined to the −Z directional end of the first flat plate portion 23A via a step portion 23D and extending in a YZ plane.

The −Z directional end of the first arm portion 23F forms a free end and is provided with a curved portion 23K curved to be rounded on the −X direction side.

The surface of the first flat plate portion 23A on the +X direction side forms a contact portion 23L that is to make contact with a contact of a counter connector (not shown). A portion of the first flat plate portion 23A on the −Z direction side, the step portion 23D and the second arm portion 23G constitute a retained portion 23M to be retained by the first insulator 25. Further, the fixing portion 23B forms a retained portion 23N to be retained by the first insulator 25.

The surface of the curved portion 23K of the first arm portion 23F on the +X direction side forms a first connection portion 23P that is to make contact with one surface of the connection object C. The surface of the second arm portion 23G on the −X direction side forms a second connection portion 23Q that is to make contact with the other surface of the connection object C. Thus, the first connection portion 23P and the second connection portion 23Q face each other in the X direction.

The surface of the curved portion 23K of the first arm portion 23F on the −X direction side forms a pressing force receiving portion 23R that is to receive a pressing force from the pressing force applying surface 27G of the second insulator 27 shown in FIG. 32 and consequently press the first connection portion 23P against the second connection portion 23Q when the second insulator 27 is assembled to the first insulator 25. The pressing force receiving portion 23R is disposed in the curved portion 23K to face the opposite side from the second connection portion 23Q with respect to the first connection portion 23P.

Note that the contacts 23 to be retained in the retaining grooves 25F on, of the opposite sides in the X direction, the −X direction side of the projection portion 25B of the first insulator 25 shown in FIG. 26 have the same structure as that of the contact 23 shown in FIGS. 33 to 35 but are placed in the opposite orientation therefrom in the X direction.

Attachment of the connector 21 to the connection object C is described below.

Figure 36:
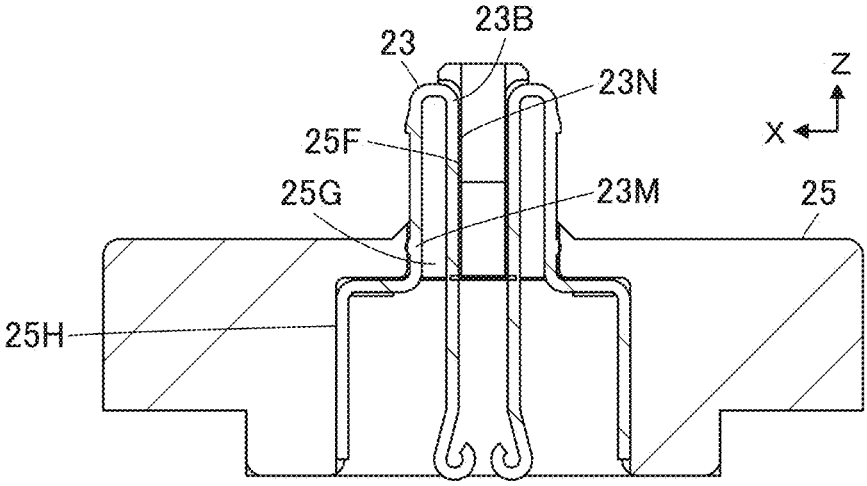
FIG. 36 is a cross-sectional view showing an assembly of the first insulator and the contact in Embodiment 2.

First, as shown in FIG. 36, the contacts 23 are inserted into the through-holes 25G of the first insulator 25 from the −Z direction side and then placed along the retaining grooves 25F of the projection portion 25B projecting in the +Z direction and the retaining grooves 25H of the recess portion 25D. In this process, the fixing portion 23B of the contact 23 is fixed to the +Z directional end of the retaining groove 25F.

Next, the projection portion 25E formed on the first surface 25C of the base portion 25A of the first insulator 25 is inserted into the opening B1 of the tab sheet B, and the connection object C is disposed on the surface of the tab sheet B on the −Z direction side. In this process, the connection object C is disposed such that the tip portions C3 are situated inside the opening B1 of the tab sheet B when viewed in the Z direction. In this state, the second insulator 27 shown in FIG. 30 is positioned with respect to the first insulator 25 such that the convex portion 27B of the second insulator 27 is aligned with the recess portion 25D of the first insulator 25 along the predetermined assembling direction D1, i.e., the +Z direction.

Figure 37:
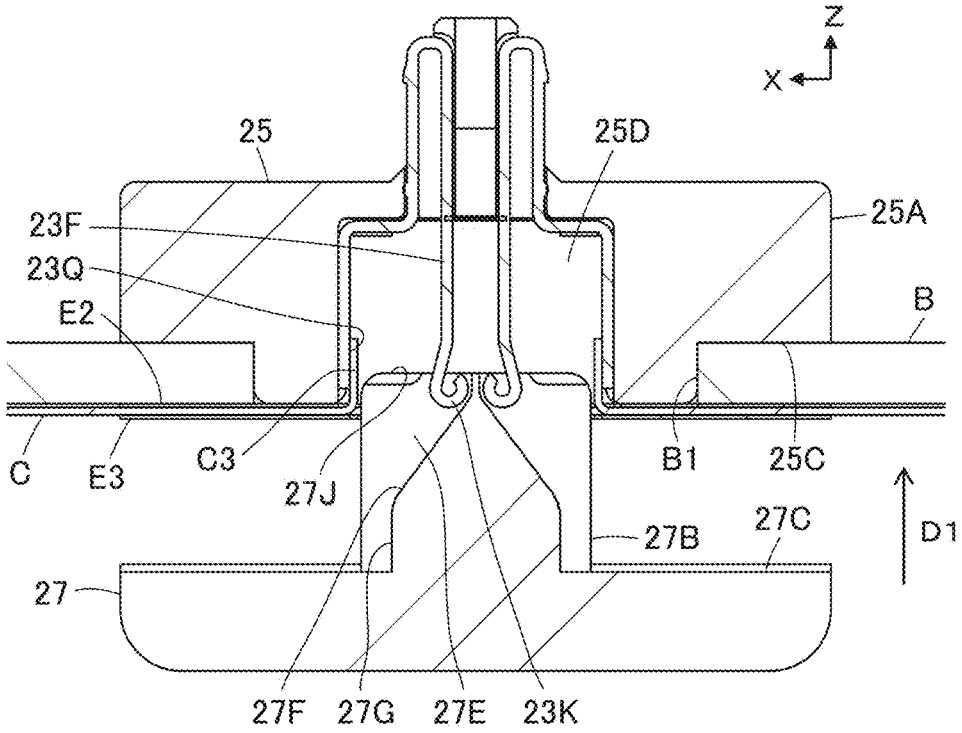
FIG. 37 is a view showing the state where assembling of the second insulator to the first insulator is started.

The thus positioned second insulator 27 is linearly moved toward the first insulator 25 in the +Z direction. Assembling of the second insulator 27 to the first insulator 25 is thus started as shown in FIG. 37.

In the state where the convex portion 27B of the second insulator 27 is inserted in the recess portion 25D of the first insulator 25, there is a gap slightly wider than the thickness of the connection object C between the convex portion 27B of the second insulator 27 and a surface of the second connection portion 23Q of the contact 23. Accordingly, as the second insulator 27 is inserted into the first insulator 25 in the +Z direction, the tip portions C3 of the connection object C situated inside the opening B1 of the tab sheet B when viewed in the Z direction are bent toward the +Z direction by the connection object bending portions 27J of the second insulator 27. This allows surfaces of the tip portions C3 of the connection object C to face the second connection portions 23Q of the contacts 23. Since a worker who assembles the connector 21 need not manually bend the tip portions C3 of the connection object C, the worker can easily assemble the connector 21.

The curved portion 23K of the contact 23 is inserted into the groove 27E of the second insulator 27, and as the second insulator 27 is moved toward the first insulator 25 in the +Z direction, the curved portion 23K is pushed by the guide surface 27F of the second insulator 27 and thereby displaced in the X direction to approach the second arm portion 23G. When the second insulator 27 is further moved in the +Z direction, the curved portion 23K of the first arm portion 23F reaches the −Z directional end of the guide surface 27F and thereafter keeps its contact with the pressing force applying surface 27G.

The second insulator 27 is moved in the +Z direction until the connection object C is sandwiched between the first surface 25C of the first insulator 25 and the second surface 27C of the second insulator 27 and also the convex portion 27B of the second insulator 27 is totally accommodated in the recess portion 25D of the first insulator 25, whereby the second insulator 27 is assembled to the first insulator 25.

Attachment of the connector 21 to the connection object C is thus completed as shown in FIG. 25.

Various portions of the connector 21 can be bonded by the adhesive sheets E1, E2 and E3 as with the connector 11 of Embodiment 1.

Figure 38:
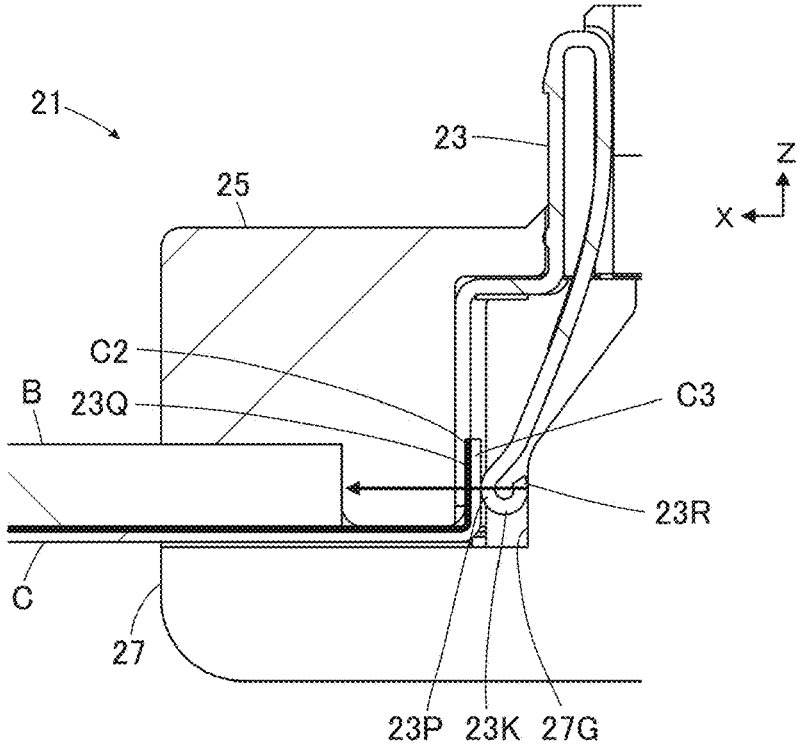
FIG. 38 is an enlarged view of an important part of FIG. 25.

As shown in FIG. 38, in the connector 21, the pressing force receiving portion 23R of the curved portion 23K of the contact 23 situated on the +X direction side receives a pressing force acting in the +X direction from the pressing force applying surface 27G of the second insulator 27, whereby the first connection portion 23P of the curved portion 23K is pressed against the tip portion C3 of the connection object C. Accordingly, the tip portion C3 of the connection object C is sandwiched between the first connection portion 23P and the second connection portion 23Q of the contact 23. Since the flexible conductors C2 of the connection object C are exposed on the surface of the substrate C1 on the second connection portion 23Q side in the tip portion C3, the flexible conductors C2 make contact with the second connection portion 23Q. Thus, the flexible conductors C2 of the connection object C are electrically connected to the contact 23 via the second connection portion 23Q.

Further, the pressing force receiving portion 23R of the curved portion 23K of the contact 23 situated on the −X direction side receives a pressing force acting in the −X direction from the pressing force applying surface 27G of the second insulator 27. Consequently, the first connection portion 23P is pressed against the tip portion C3 of the connection object C, so that the tip portion C3 of the connection object C is sandwiched between the first connection portion 23P and the second connection portion 23Q of the contact 23. Thus, the contact 23 situated on the −X direction side is also electrically connected to the flexible conductors C2 of the connection object C in the same manner as the contact 23 situated on the +X direction side.

As described above, in the connector 21 according to Embodiment 2 of the invention, the opposite surfaces of the connection object C are sandwiched between the first connection portion 23P and the second connection portion 23Q of the contact 23 as with the connector 11 according to Embodiment 1; therefore, even when the flexible conductors C2 are exposed on, of the opposite surfaces, either surface of the substrate C1, the corresponding one of the first connection portion 23P and the second connection portion 23Q makes contact with the flexible conductors C2, thus establishing a reliable electrical connection between the flexible conductors C2 and the contact 23.

Aside from that, as shown in FIG. 37, when the convex portion 27B of the second insulator 27 is inserted into the recess portion 25D of the first insulator 25, a gap wider in the X direction than the thickness of the connection object C is formed between the surface of the second connection portion 23Q of the contact 23 and the surface of the convex portion 27B; therefore, the connection object C does not receive a pressing force acting in the X direction from the convex portion 27B of the second insulator 27 before being sandwiched between the first connection portion 23P and the second connection portion 23Q of the contact 23. This configuration makes it possible to prevent the flexible conductors C2 from being scratched by the second insulator 27 in making an electrical connection between the flexible conductors C2 and the contact 23.

Furthermore, the connection object C receives a force acting in the X direction perpendicular to the +Z direction, which is the predetermined assembling direction D1, from the first connection portion 23P and the second connection portion 23Q of the contact 23; therefore, it is unlikely that the second insulator 27 assembled with the first insulator 25 is separated from the first insulator 25 due to the force to sandwich the connection object C by the first and second connection portions 23P and 23Q of the contact 23, thus making it possible to maintain the connector 21 in a stable state. The direction in which the first connection portion 23P and the second connection portion 23Q sandwich the connection object C therebetween need not necessarily be perpendicular to the predetermined assembling direction D1 but preferably crosses the predetermined assembling direction D1.

Embodiment 3

Figure 39:
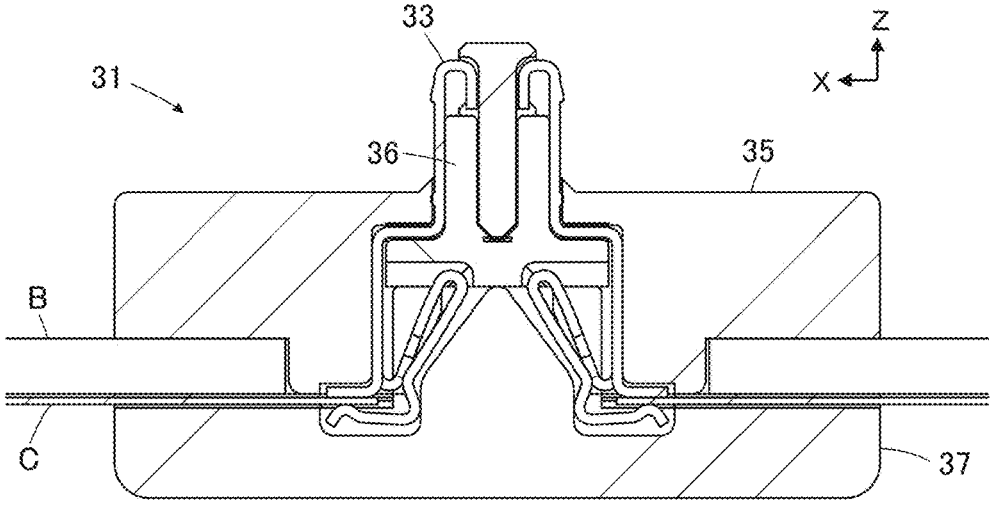
FIG. 39 is a cross-sectional view of the structure of a connector according to Embodiment 3.

FIG. 39 shows a connector 31 according to Embodiment 3 attached to the connection object C. The connector 31 includes a first insulator 35, an inner insulator 36, a second insulator 37, and a plurality of contacts 33 retained by the first insulator 35 and the second insulator 37. The contacts 33 are retained to project perpendicularly to the connection object C in two lines parallel to each other.

For convenience, the connection object C is defined as extending in an XY plane, the direction in which the contacts 33 are aligned is referred to as "Y direction," and the direction in which the contacts 33 project is referred to as "+Z direction."

Figure 40:
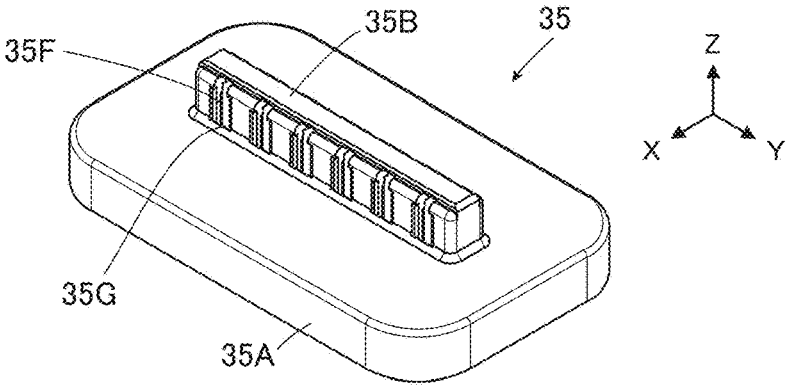
FIG. 40 is a perspective view of a first insulator used in the connector according to Embodiment 3, as viewed from an obliquely upper position.
Figure 41:
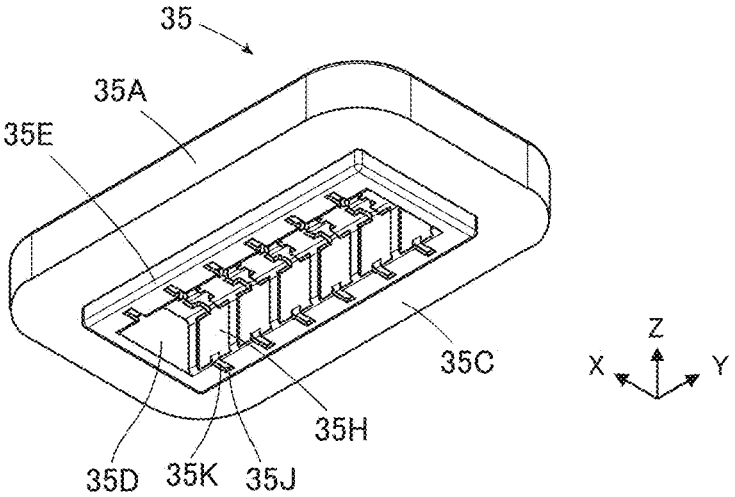
FIG. 41 is a perspective view of the first insulator used in the connector according to Embodiment 3, as viewed from an obliquely lower position.
Figure 42:
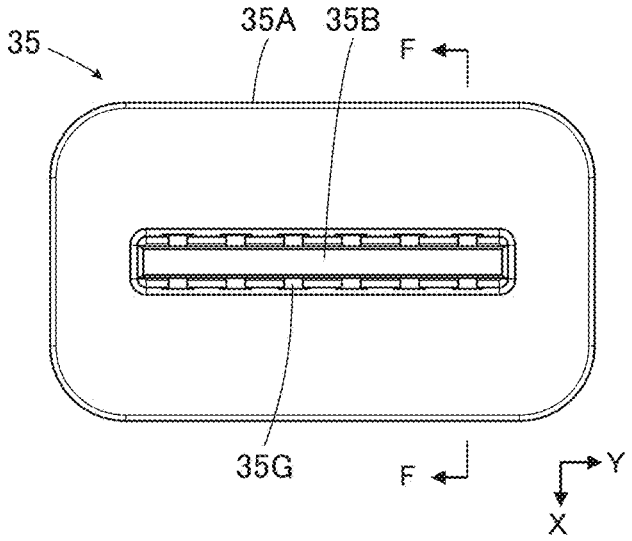
FIG. 42 is a top view of the first insulator used in the connector according to Embodiment 3.

As shown in FIGS. 40 to 42, the first insulator 35 includes a base portion 35A extending in an XY plane and a projection portion 35B situated in the center of the base portion 35A and projecting in the +Z direction from the base portion 35A. The base portion 35A and the projection portion 35B each have a substantially rectangular outer shape with the long sides extending in the Y direction and the short sides extending in the X direction when viewed in the Z direction.

A recess portion 35D opening in the −Z direction is formed at a first surface 35C that is on the −Z direction side of the base portion 35A and is parallel to an XY plane, and a projection portion 35E projecting in the −Z direction is formed along the circumference of the recess portion 35D.

Figure 43:
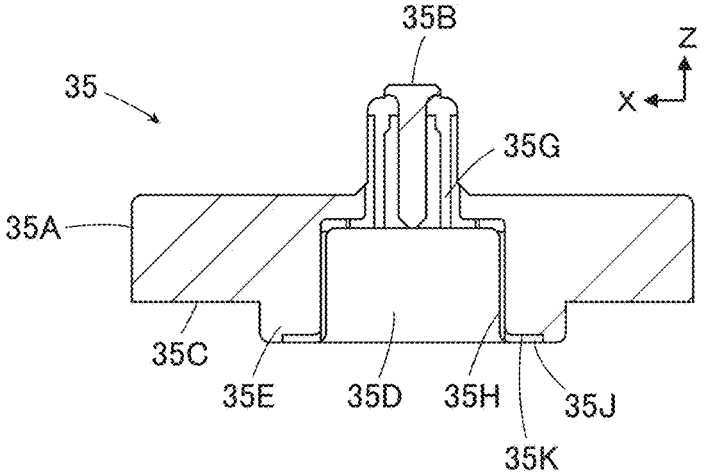
FIG. 43 is a cross-sectional view taken along line F-F in FIG. 42.

A plurality of retaining grooves 35F extending in the Z direction and used to retain the contacts 33 are formed at the opposite surfaces in the X direction of the projection portion 35B projecting in the +Z direction. A plurality of through-holes 35G are formed in the base portion 35A to penetrate from the surface of the base portion 35A on the +Z direction side up to the recess portion 35D in such a manner that the through-holes 35G correspond to the retaining grooves 35F on the opposite sides in the X direction. The recess portion 35D is provided with a plurality of retaining grooves 35H that are connected to the retaining grooves 35F via the through-holes 35G and used to retain the contacts 33. As shown in FIG. 43, the retaining grooves 35H extend in the X direction from the −Z directional ends of the through-holes 35G along the inner surface of the recess portion 35D and then extend in the −Z direction.

Furthermore, retaining grooves 35J that are connected to the retaining grooves 35H formed at the inner wall of the recess portion 35D and extend in the X direction in parallel to a XY plane are formed at portions of the projection portion 35E projecting in the −Z direction, the portions being on the opposite sides in the X direction corresponding to the pair of long sides of the projection portion 35E. The bottom surface of each retaining groove 35J forms a second connection portion placement surface 35K being parallel to an XY plane and extending in the X direction. Accordingly, the second connection portion placement surface 35K is situated between the opening end of the recess portion 35D and the first surface 35C.

Figure 44:
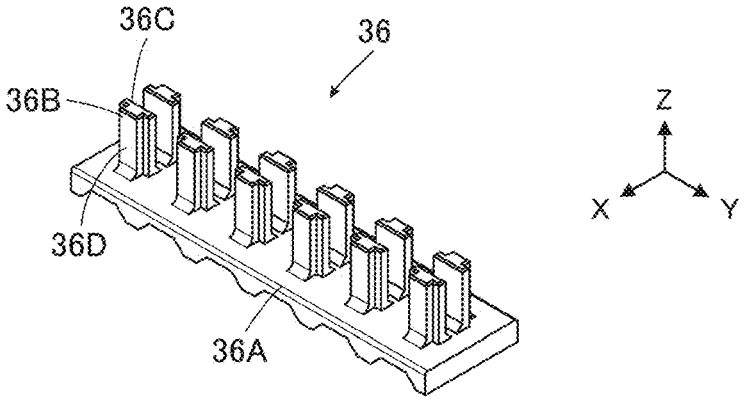
FIG. 44 is a perspective view of an inner insulator used in the connector according to Embodiment 3, as viewed from an obliquely upper position.
Figure 45:
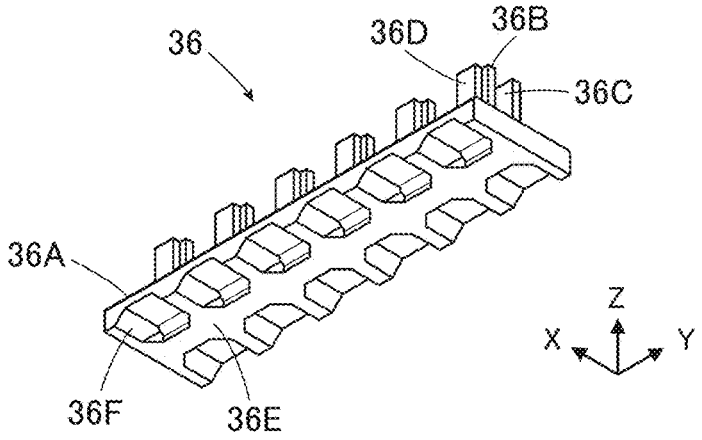
FIG. 45 is a perspective view of the inner insulator used in the connector according to Embodiment 3, as viewed from an obliquely lower position.

As shown in FIGS. 44 and 45, the inner insulator 36 includes a base portion 36A of flat plate shape extending in an XY plane and a plurality of protrusion portions 36B aligned in the Y direction in two lines parallel to each other in the center of the base portion 36A and protruding in the +Z direction from the base portion 36A. The base portion 36A has a substantially rectangular outer shape with the long sides extending in the Y direction and the short sides extending in the X direction when viewed in the Z direction. A part of the protrusion portions 36B situated on the +X direction side with respect to the center of the base portion 36A and the other part of the protrusion portions 36B situated on the −X direction side with respect to the center of the base portion 36A are symmetrical to each other in shape about a YZ plane passing through the center of the base portion 36A.

The protrusion portions 36B are to be inserted in the retaining grooves 35F of the first insulator 35, and each protrusion portion 36B has an inner surface 36C that faces the middle in the X direction of the base portion 36A and is parallel to a YZ plane and an outer surface 36D that faces the outside in the X direction of the base portion 36A and is parallel to a YZ plane.

A projection portion 36E projecting in the −Z direction and extending in the Y direction is formed on the surface of the base portion 36A on the −Z direction side. A plurality of recess portions 36F are formed in the projection portion 36E at positions corresponding to the retaining grooves 35F of the first insulator 35 shown in FIG. 45.

Figure 46:
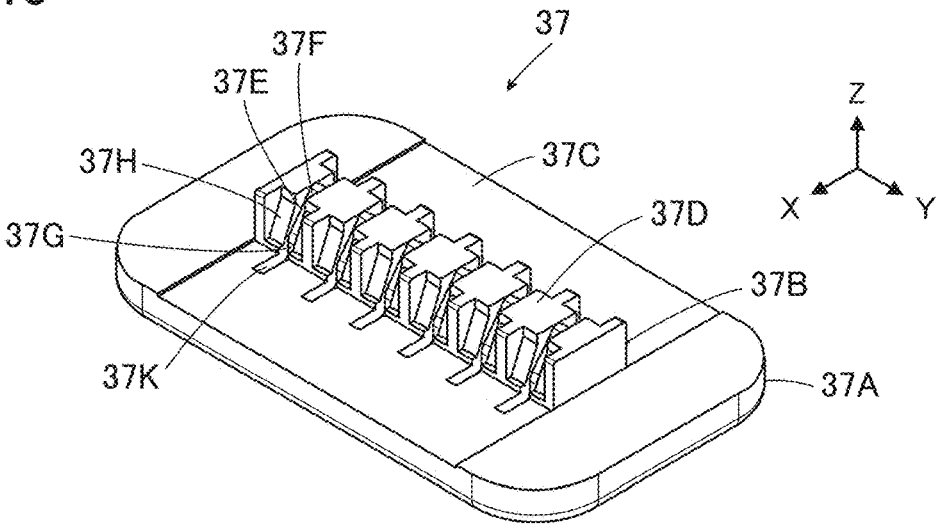
FIG. 46 is a perspective view of a second insulator used in the connector according to Embodiment 3, as viewed from an obliquely upper position.
Figure 47:
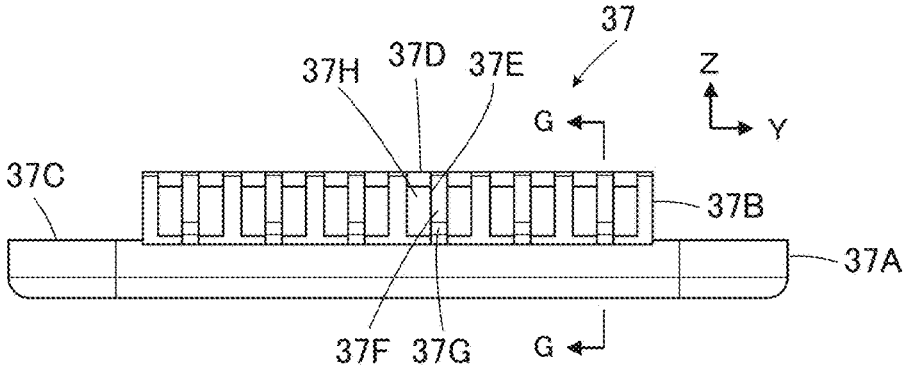
FIG. 47 is a front view of the second insulator used in the connector according to Embodiment 3.
Figure 48:
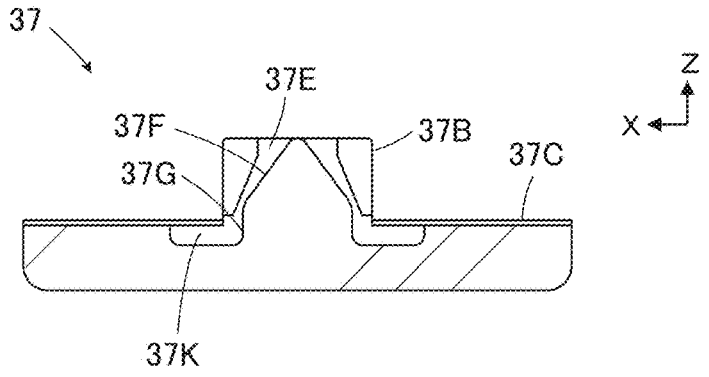
FIG. 48 is a cross-sectional view taken along line G-G in FIG. 47.

As shown in FIGS. 46 to 48, the second insulator 37 includes a base portion 37A of flat plate shape extending in an XY plane and a convex portion 37B situated in the center of the base portion 37A and projecting in the +Z direction from the base portion 37A. The base portion 37A is provided with a second surface 37C facing in the +Z direction and being parallel to an XY plane. The base portion 37A and the convex portion 37B each have a substantially rectangular outer shape with the long sides extending in the Y direction and the short sides extending in the X direction when viewed in the Z direction.

The convex portion 37B is to be inserted in the recess portion 35D of the first insulator 35 and has a size slightly smaller than that of the recess portion 35D in an XY plane.

The convex portion 37B is provided with a top surface 37D parallel to an XY plane. Grooves 37E are formed at the top surface 37D and the opposite lateral surfaces in the X direction of the convex portion 37B to extend up to the second surface 37C while being inclined to the Z direction. Furthermore, grooves 37K being connected to the grooves 37E of the convex portion 37B and extending in the X direction are formed in the base portion 37A.

Each groove 37E on the +X direction side is provided on its bottom with a guide surface 37F that is inclined to the Z direction to face in the +X direction and the +Z direction and a pressing force applying surface 37G that is adjacent to the −Z direction side of the guide surface 37F and extends in a YZ plane.

On the +X direction side of the convex portion 37B, inclined surfaces 37H being more inclined to the Z direction than the guide surfaces 37F are formed on the opposite sides in the Y direction of each groove 37E.

Each groove 37E on the −X direction side is provided on its bottom with a guide surface 37F and a pressing force applying surface 37G that are symmetrical to the guide surface 37F and the pressing force applying surface 37G on the +X direction side in shape about a YZ plane. On the −X direction side of the convex portion 37B, a plurality of inclined surfaces 37H are formed in the same manner as on the +X direction side.

Figure 49:
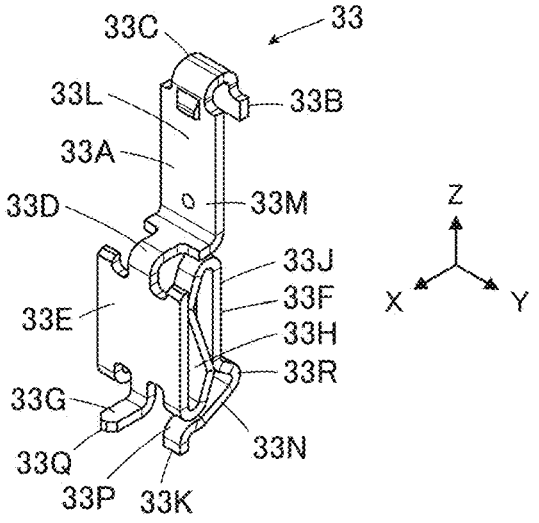
FIG. 49 is a perspective view of a contact used in the connector according to Embodiment 3, as viewed from the anterior side (front side).
Figure 50:
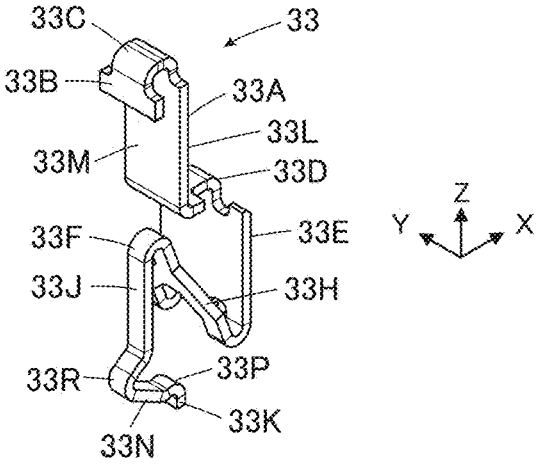
FIG. 50 is a perspective view of the contact used in the connector according to Embodiment 3, as viewed from the posterior side (back side).
Figure 51:
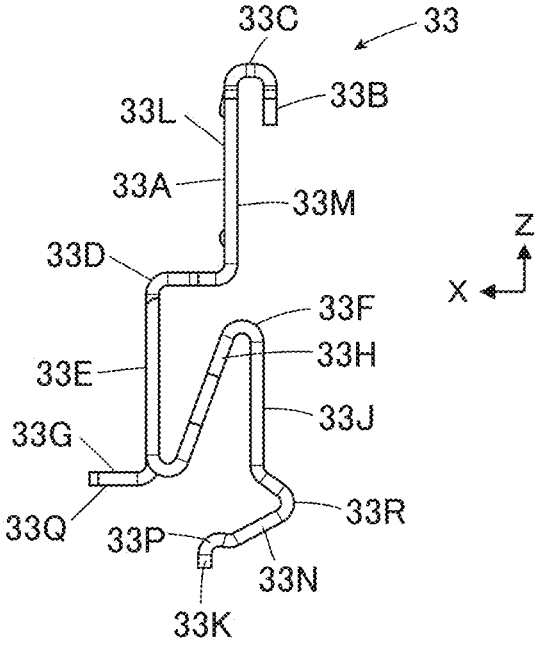
FIG. 51 is a side view of the contact used in the connector according to Embodiment 3.

FIGS. 49 to 51 show the structure of the contact 33 to be retained in the retaining groove 35F on, of the opposite sides in the X direction, the +X direction side of the projection portion 35B of the first insulator 35 shown in FIG. 40.

The contact 33 is constituted of a band-like member made of a conductive material such as metal and includes a first flat plate portion 33A extending in a YZ plane, a fixing portion 33B extending in a YZ plane, being situated on the −X direction side of the first flat plate portion 33A and being shorter than the first flat plate portion 33A in the Z direction, and a joint portion 33C joining the +Z directional ends of the first flat plate portion 33A and the fixing portion 33B together. A second flat plate portion 33E extending in a YZ plane is connected via a step portion 33D to the −Z directional end of the first flat plate portion 33A.

The contact 33 further includes a first arm portion 33F and a second arm portion 33G. The first arm portion 33F has a forked portion 33H that extends from two portions at the opposite ends in the Y direction of the −Z directional end of the second flat plate portion 33E, is bent toward the −X direction and the +Z direction and then extends in a direction inclined to the Z direction and an extension portion 33J that extends in the −Z direction from the +Z directional end of the forked portion 33H. The second arm portion 33G is bent from the middle in the Y direction of the −Z directional end of the second flat plate portion 33E and extends in the +X direction. The −Z directional end of the extension portion 33J forms a free end and is provided with a bent portion 33N that is bent from this −Z directional end toward the −X direction side and then toward the +X direction side. The −Z directional end of the bent portion 33N is provided with a curved portion 33K curved to the −Z direction side.

The surface of the first flat plate portion 33A on the +X direction side forms a contact portion 33L that is to make contact with a contact of a counter connector (not shown). A portion of the first flat plate portion 33A on the −Z direction side, the step portion 33D and the second flat plate portion 33E constitute a retained portion 33M to be retained between the first insulator 35 and the second insulator 37.

The surface of the top of the curved portion 33K of the first arm portion 33F on the +Z direction side forms a first connection portion 33P that is to make contact with one surface of the connection object C. The surface of the second arm portion 33G on the −Z direction side forms a second connection portion 33Q that is to make contact with the other surface of the connection object C. Thus, the first connection portion 33P and the second connection portion 33Q are situated to face each other.

The surface of the −X directional end of the bent portion 33N on the −X direction side forms a pressing force receiving portion 33R that is to receive a pressing force from the pressing force applying surface 37G of the second insulator 37 shown in FIG. 48 when the second insulator 37 is assembled to the first insulator 35.

Note that the contacts 33 to be retained in the retaining grooves 35F on, of the opposite sides in the X direction, the −X direction side of the projection portion 35B of the first insulator 35 shown in FIG. 40 have the same structure as that of the contact 33 shown in FIGS. 49 to 51 but are placed in the opposite orientation therefrom in the X direction.

Attachment of the connector 31 to the connection object C is described below.

Figure 52:
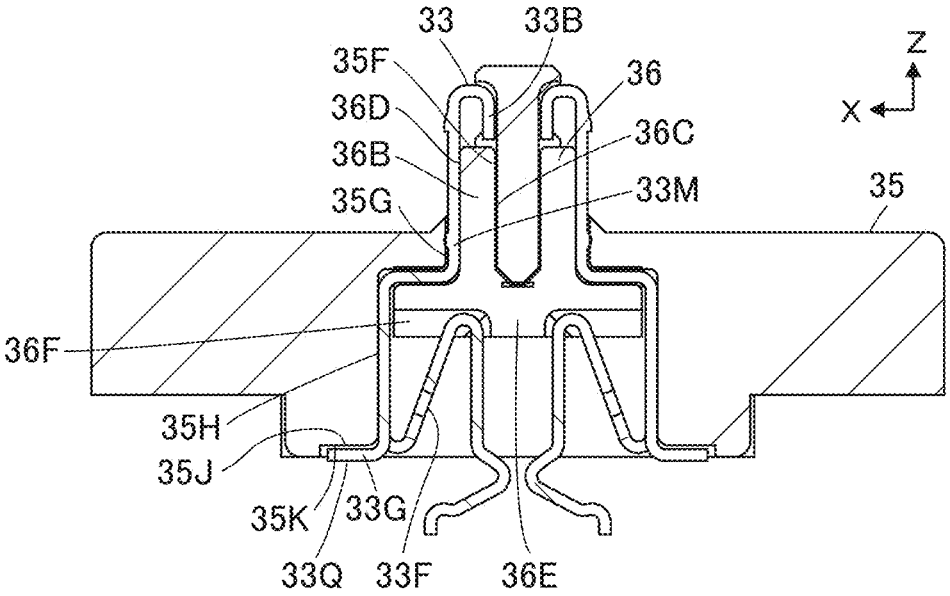
FIG. 52 is a cross-sectional view showing an assembly of the first insulator, the inner insulator and the contact in Embodiment 3.

First, as shown in FIG. 52, the contacts 33 are inserted into the through-holes 35G of the first insulator 35 from the −Z direction side and then placed along the retaining grooves 35F of the projection portion 35B projecting in the +Z direction, the retaining grooves 35H of the recess portion 35D, and the retaining grooves 35J formed in the projection portion 35E. In this process, the fixing portion 33B of the contact 33 is fixed to the +Z directional end of the retaining groove 35F. The +Z directional end of the first arm portion 33F of the contact 33 is situated within the recess portion 36F formed in the projection portion 36E of the inner insulator 36 without contact with the inner insulator 36. The −Z directional end of the second arm portion 33G of the contact 33 is disposed on the second connection portion placement surface 35K of the retaining groove 35J such that the second connection portion 33Q faces in the −Z direction. Thus, the second connection portion 33Q is disposed along the second connection portion placement surface 35K.

In this state, the protrusion portions 36B of the inner insulator 36 are inserted into the through-holes 35G of the first insulator 35. In this process, the protrusion portion 36B is inserted into the through-hole 35G of the first insulator 35 such that the inner surface 36C faces the retaining groove 35F of the first insulator 35 and the outer surface 36D faces the contact 33. Thus, the retained portion 33M of the contact 33 is disposed between the first insulator 35 and the inner insulator 36.

Figure 53:
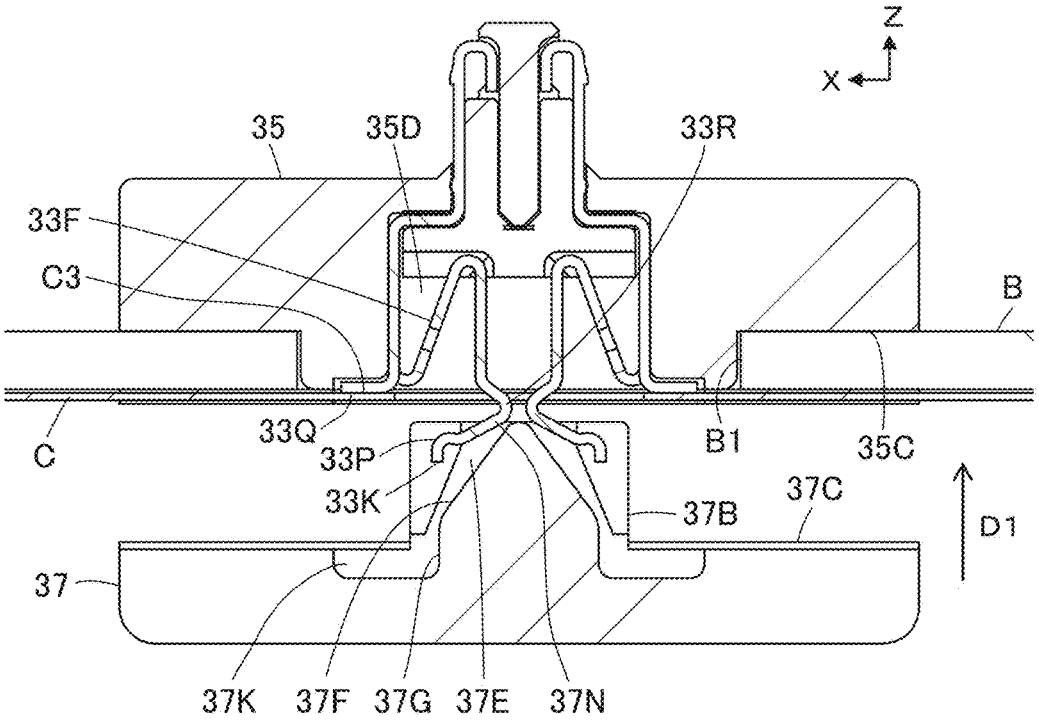
FIG. 53 is a view showing the state where assembling of the second insulator to the first insulator is started.

Next, as shown in FIG. 53, the projection portion 35E formed on the first surface 35C of the base portion 35A of the first insulator 35 is inserted into the opening B1 of the tab sheet B, and the connection object C is disposed on the surface of the tab sheet B on the −Z direction side. In this process, the connection object C is disposed such that the tip portions C3 are situated inside the opening B1 of the tab sheet B when viewed in the Z direction. In this state, the second insulator 37 is positioned with respect to the first insulator 35 such that the convex portion 37B of the second insulator 37 is aligned with the recess portion 35D of the first insulator 35 along the predetermined assembling direction D1, i.e., the +Z direction.

The thus positioned second insulator 37 is linearly moved toward the first insulator 35 in the +Z direction. Assembling of the second insulator 37 to the first insulator 35 is thus started as shown in FIG. 53.

When the second insulator 37 is moved toward the first insulator 35, the bent portion 33N of the contact 33 is inserted into the groove 37E of the second insulator 37. As the second insulator 37 is moved toward the first insulator 35 in the +Z direction, the bent portion 33N is pushed by the guide surface 37F of the second insulator 37 and thereby displaced toward the second connection portion 33Q side with the +Z directional end of the first arm portion 33F serving as the fulcrum. At this time, since the bent portion 33N is bent toward the outside in the X direction of the first insulator 35 and the second insulator 37, the curved portion 33K formed at the end of the bent portion 33N is displaced to approach the second connection portion 33Q from the −Z direction side.

When the second insulator 37 is further moved in the +Z direction, the pressing force receiving portion 33R formed at the bent portion 33N reaches the −Z directional end of the guide surface 37F and thereafter keeps its contact with the pressing force applying surface 37G. At this time, the bent portion 33N and the curved portion 33K of the contact 33 are accommodated in the groove 37K of the second insulator 37.

The second insulator 37 is moved in the +Z direction until the connection object C is sandwiched between the first surface 35C of the first insulator 35 and the second surface 37C of the second insulator 37 and also the convex portion 37B of the second insulator 37 is totally accommodated in the recess portion 35D of the first insulator 35, whereby the second insulator 37 is fully assembled to the first insulator 35.

Attachment of the connector 31 to the connection object C is thus completed as shown in FIG. 39.

Various portions of the connector 31 can be bonded by the adhesive sheets E1, E2 and E3 as with the connector 11 of Embodiment 1.

Figure 54:
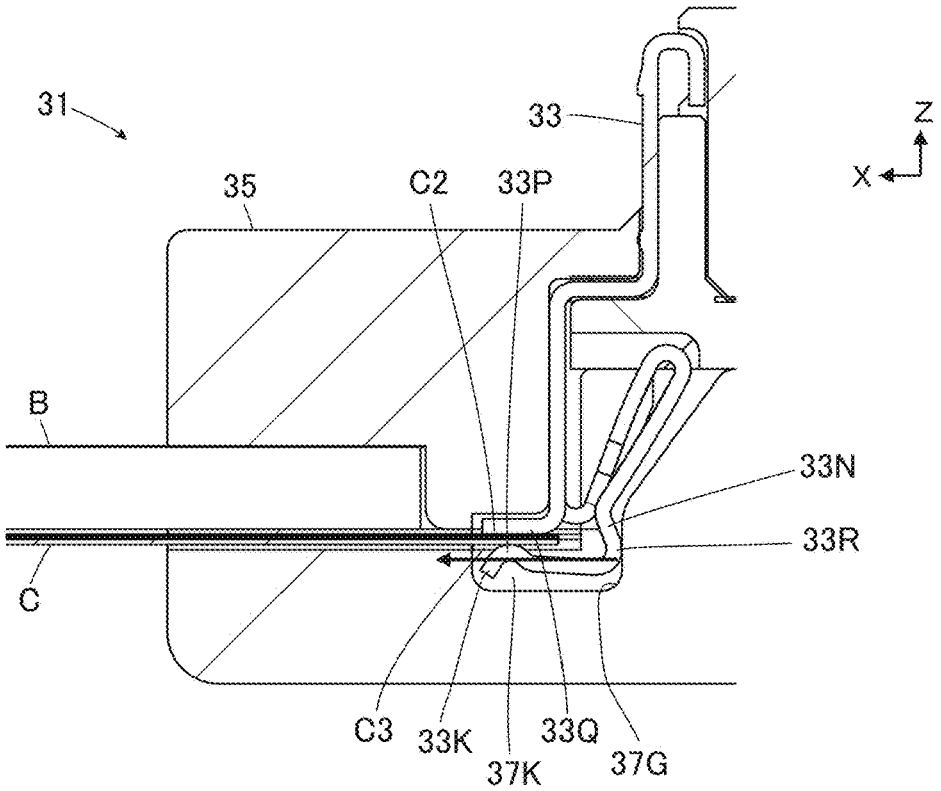
FIG. 54 is an enlarged view of an important part of FIG. 39.

As shown in FIG. 54, in the connector 31, the pressing force receiving portion 33R of the contact 33 situated on the +X direction side receives a pressing force acting in the +X direction from the pressing force applying surface 37G of the second insulator 37, whereby the first connection portion 33P of the curved portion 33K formed at the end of the bent portion 33N is pressed against the surface of the tip portion C3 of the connection object C on the −Z direction side. Accordingly, the tip portion C3 of the connection object C is sandwiched from the opposite sides in the Z direction between the first connection portion 33P and the second connection portion 33Q of the contact 33. Since the flexible conductors C2 of the connection object C are exposed on the surface on the +Z direction side, i.e., the surface on the second connection portion 33Q side, the flexible conductors C2 make contact with the second connection portion 33Q. Thus, the flexible conductors C2 of the connection object C are electrically connected to the contact 33 via the second connection portion 33Q.

Further, the pressing force receiving portion 33R of the contact 33 situated on the −X direction side receives a pressing force acting in the −X direction from the pressing force applying surface 37G of the second insulator 37. Consequently, the first connection portion 33P is pressed against the tip portion C3 of the connection object C from the −Z direction side, so that the tip portion C3 of the connection object C is sandwiched from the opposite sides in the Z direction between the first connection portion 33P and the second connection portion 33Q of the contact 33. Thus, the contact 33 situated on the −X direction side is also electrically connected to the flexible conductors C2 of the connection object C in the same manner as the contact 33 situated on the +X direction side.

As described above, in the connector 31 according to Embodiment 3 of the invention, the opposite surfaces of the connection object C are sandwiched between the first connection portion 33P and the second connection portion 33Q of the contact 33 as with the connectors 11 and 21 according to Embodiments 1 and 2; therefore, even when the flexible conductors C2 are exposed on, of the opposite surfaces, either surface of the substrate C1, the corresponding one of the first connection portion 33P and the second connection portion 33Q makes contact with the flexible conductors C2, thus establishing a reliable electrical connection between the flexible conductors C2 and the contact 33.

Further, as shown in FIG. 53, when the convex portion 37B of the second insulator 37 is inserted into the recess portion 35D of the first insulator 35, the second connection portion 33Q of the contact 33 faces in the −Z direction, i.e., the direction parallel to the predetermined assembling direction D1, and makes no contact with the second insulator 37. This configuration makes it possible to prevent the flexible conductors C2 from being scratched by the second insulator 37 in making an electrical connection between the flexible conductors C2 and the contact 33.

Aside from that, while the connection object C is sandwiched from its opposite sides in the Z direction between the first connection portion 33P and the second connection portion 33Q of the contact 33, the pressing force receiving portion 33R of the contact 33 receives a pressing force acting in a direction parallel to the X direction from the pressing force applying surface 37G of the second insulator 37, and accordingly, the first insulator 35 and the second insulator 37 do not receive a force acting along the predetermined assembling direction D1, i.e., the Z direction from the contact 33. Therefore, it is unlikely that the first insulator 35 and the second insulator 37 are separated from each other due to the force applied from the contact 33, thus making it possible to maintain the connector 31 in a stable state. The direction in which the first connection portion 33P and the second connection portion 33Q sandwich the connection object C therebetween is not particularly limited and need not be parallel to the predetermined assembling direction D1.

Embodiment 4

Figure 55:
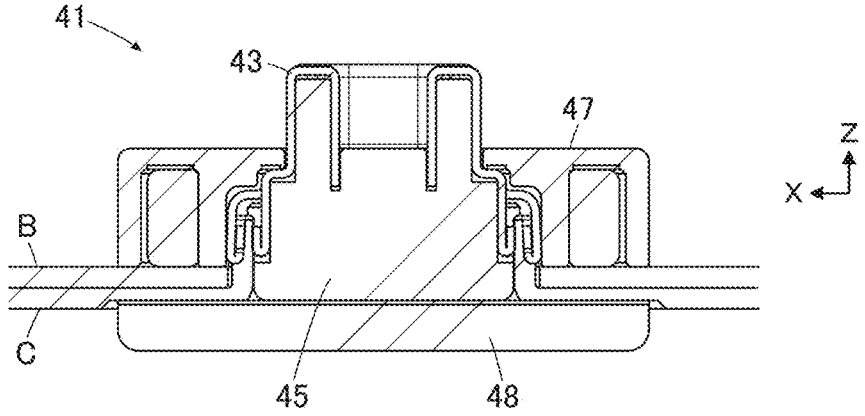
FIG. 55 is a cross-sectional view of the structure of a connector according to Embodiment 4.

FIG. 55 shows a connector 41 according to Embodiment 4 attached to the connection object C. The connector 41 includes a first insulator 45, a second insulator 47, a third insulator 48, and a plurality of contacts 43 retained by the first insulator 45 and the second insulator 47. The contacts 43 are retained to project perpendicularly to the connection object C in two lines parallel to each other.

For convenience, the connection object C is defined as extending in an XY plane, the direction in which the contacts 43 are aligned is referred to as "Y direction," and the direction in which the contacts 43 project is referred to as "+Z direction."

Figure 56:
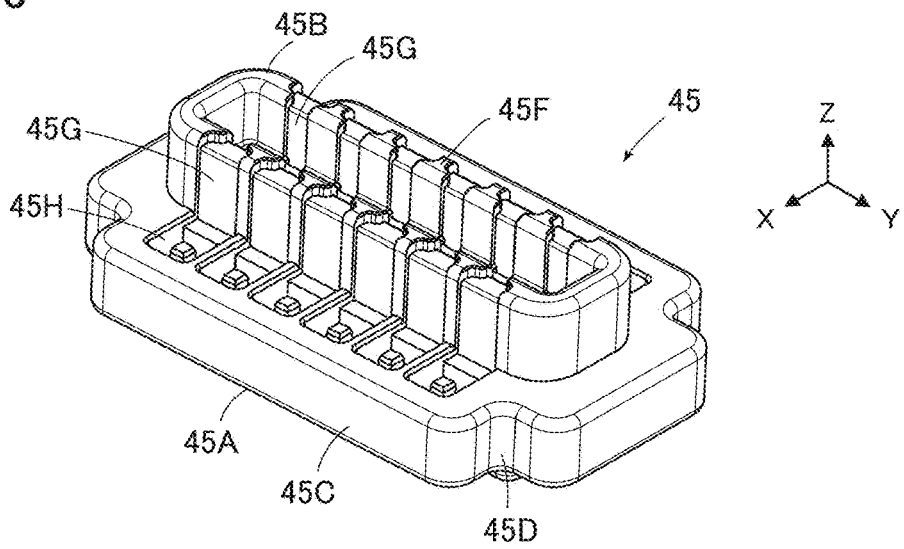
FIG. 56 is a perspective view of a first insulator used in the connector according to Embodiment 4, as viewed from an obliquely upper position.
Figure 57:
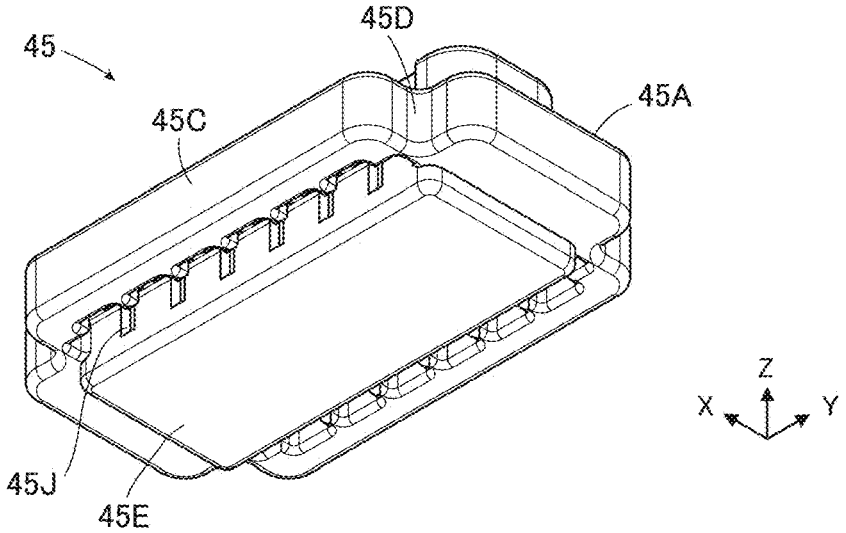
FIG. 57 is a perspective view of the first insulator used in the connector according to Embodiment 4, as viewed from an obliquely lower position.

As shown in FIGS. 56 to 57, the first insulator 45 includes a base portion 45A extending in an XY plane and a projection portion 45B of frame shape situated in the center of the base portion 45A and projecting in the +Z direction from the base portion 45A. The base portion 45A and the projection portion 45B each have a substantially rectangular outer shape with the long sides extending in the Y direction and the short sides extending in the X direction when viewed in the Z direction.

The base portion 45A has lateral surfaces 45C interconnecting the surface on the +Z direction side and the surface on the −Z direction side and being perpendicular to an XY plane, and the lateral surfaces 45C extending along a YZ plane and the lateral surfaces 45C extending along an XZ plane are connected by cutout portions 45D.

A projection portion 45E projecting in the −Z direction is formed on the surface of the base portion 45A on the −Z direction side. The projection portion 45B of frame shape has a pair of long side portions 45F facing each other in the X direction and extending in the Y direction, and each long side portion 45F is provided at its outer surface and inner surface with a plurality of retaining grooves 45G extending in the Z direction and serving to retain the contacts 43.

A plurality of through-holes 45H are formed in the base portion 45A to penetrate from the surface of the base portion 45A on the +Z direction side up to the surface thereof on the −Z direction side in such a manner that the through-holes 45H correspond to the retaining grooves 45G. The projection portion 45E projecting on the −Z direction side is provided at its opposite lateral surfaces in the X direction with retaining grooves 45J extending in the Z direction from the +Z directional end of the projection portion 45E in such a manner that the retaining grooves 45J correspond to the retaining grooves 45G. Although not shown in FIGS. 56 and 57, a plurality of insertion holes connected to the retaining grooves 45G are formed to extend in the −Z direction in the base portion 45A in the region surrounded by the projection portion 45B of frame shape.

Figure 58:
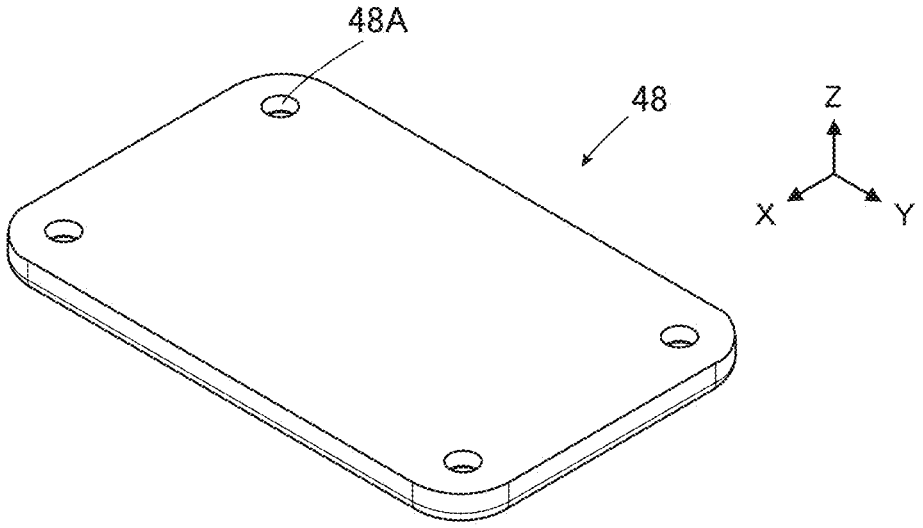
FIG. 58 is a perspective view of a third insulator used in the connector according to Embodiment 4, as viewed from an obliquely upper position.

As shown in FIG. 58, the third insulator 48 has a flat plate shape extending in an XY plane and is provided with four through-holes 48A at the positions corresponding to the four cutout portions 45D of the first insulator 45 shown in FIG. 56.

Figure 59:
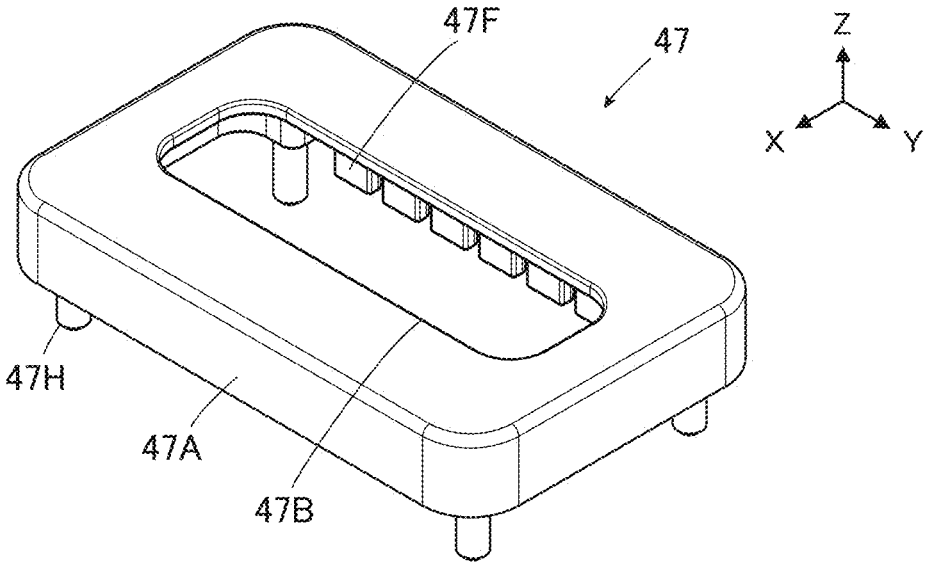
FIG. 59 is a perspective view of a second insulator used in the connector according to Embodiment 4, as viewed from an obliquely upper position.
Figure 60:
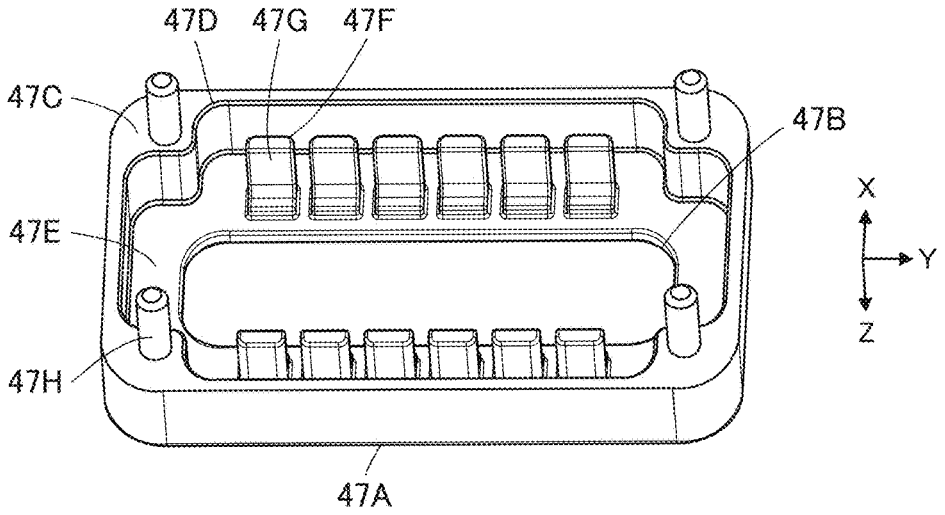
FIG. 60 is a perspective view of the second insulator used in the connector according to Embodiment 4, as viewed from an obliquely lower position.

As shown in FIGS. 59 and 60, the second insulator 47 includes a base portion 47A that extends in an XY plane and an opening 47B that is situated in the center of the base portion 47A, penetrates from the surface of the base portion 47A on the +Z direction side up to the surface thereof on the −Z direction side and extends in the Y direction. The base portion 47A and the opening 47B each have a substantially rectangular outer shape with the long sides extending in the Y direction and the short sides extending in the X direction when viewed in the Z direction. The opening 47B is to receive the projection portion 45B of the first insulator 45 and has a size slightly larger than that of the projection portion 45B in an XY plane.

The surface of the base portion 47A on the −Z direction side forms a surface 47C parallel to an XY plane, and the surface 47C is provided with a recess portion 47D having a shape corresponding to the base portion 45A of the first insulator 45 shown in FIG. 56. The recess portion 47D is provided with a bottom surface 47E that is parallel to an XY plane and is situated on the +Z direction side with respect to the surface 47C. A plurality of convex portions 47F are formed on the opposite sides in the X direction of the opening 47B to project in the −Z direction from the bottom surface 47E in such a manner that the convex portions 47F correspond to the through-holes 45H of the first insulator 45.

The convex portions 47F situated on the +X direction side are each provided with a pressing force applying surface 47G facing in the −X direction. The convex portions 47F situated on the −X direction side have the same structure as those situated on the +X direction side but are placed in the opposite orientation therefrom in the X direction.

The surface 47C of the base portion 47A on the −Z direction side is provided with fixing posts 47H of columnar shape projecting in the −Z direction in such a manner that the fixing posts 47H correspond to the four cutout portions 45D of the first insulator 45 shown in FIG. 56 and the four through-holes 48A of the third insulator 48 shown in FIG. 58.

Figure 61:
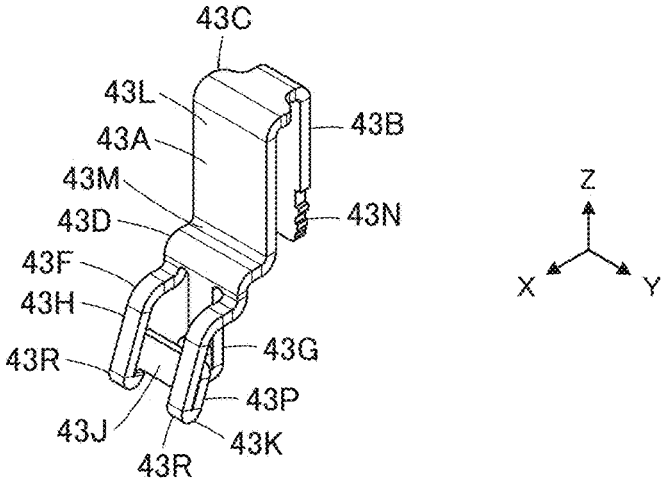
FIG. 61 is a perspective view of a contact used in the connector according to Embodiment 4, as viewed from the anterior side (front side).
Figure 62:
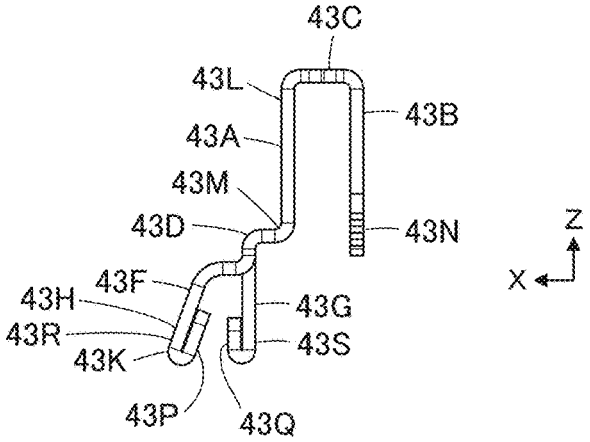
FIG. 62 is a side view of the contact used in the connector according to Embodiment 4.

FIGS. 61 and 62 show the structure of the contact 43 to be retained in the retaining groove 45G in, of the long side portions 45F on the +X and −X direction sides, the long side portion 45F on the +X direction side of the projection portion 45B of the first insulator 45 shown in FIG. 56.

The contact 43 is constituted of a band-like member made of a conductive material such as metal and includes a first flat plate portion 43A extending in a YZ plane, a fixing portion 43B extending in a YZ plane and being situated on the −X direction side of the first flat plate portion 43A, and a joint portion 43C joining the +Z directional ends of the first flat plate portion 43A and the fixing portion 43B together. The −Z directional end of the first flat plate portion 43A is connected to a step portion 43D. The contact 43 further includes a first arm portion 43F and a second arm portion 43G. The first arm portion 43F has a forked portion 43H that extends from two −Z direction-side portions at the opposite ends in the Y direction of the step portion 43D, is bent toward the +X direction side and then extends in a direction inclined to the Z direction. The second arm portion 43G extends in the −Z direction from the other −Z direction-side portion in the middle in the Y direction of the step portion 43D.

The −Z directional ends of the forked portion 43H are provided with folded portions 43K folded on the −X direction side. The tip portions of the pair of folded portions 43K are jointed together by a joint portion 43J extending in the Y direction.

The −Z directional end of the second arm portion 43G is provided with a folded portion 43S folded on the +X direction side.

The surface of the first flat plate portion 43A on the +X direction side forms a contact portion 43L that is to make contact with a contact of a counter connector (not shown). A portion of the first flat plate portion 43A on the −Z direction side, the step portion 43D and the second flat plate portion 43E constitute a retained portion 43M to be retained between the first insulator 45 and the second insulator 47.

The surfaces of the pair of folded portions 43K on the −X direction side form first connection portions 43P that are to make contact with one surface of the connection object C. The surface of the second arm portion 43G on the +X direction side forms a second connection portion 43Q that is to make contact with the other surface of the connection object C. Thus, the first connection portion 43P and the second connection portion 43Q face each other in the X direction.

The surfaces of the pair of folded portions 43K on the +X direction side form pressing force receiving portions 43R that are to receive a pressing force from the pressing force applying surface 47G formed on the convex portion 47F of the second insulator 47 shown in FIG. 60 when the second insulator 47 is assembled to the first insulator 45. The pressing force receiving portion 43R is disposed to face the opposite side from the second connection portion 43Q with respect to the first connection portion 43P.

Press-fitted portions 43N having a concave-convex shape are formed on the opposite lateral surfaces in the Y direction at the −Z directional end of the fixing portion 43B.

Note that the contacts 43 to be retained in the retaining grooves 45G on, of the opposite sides in the X direction, the −X direction side of the first insulator 45 shown in FIG. 56 have the same structure as that of the contact 43 shown in FIGS. 61 and 62 but are placed in the opposite orientation therefrom in the X direction.

Figure 63:
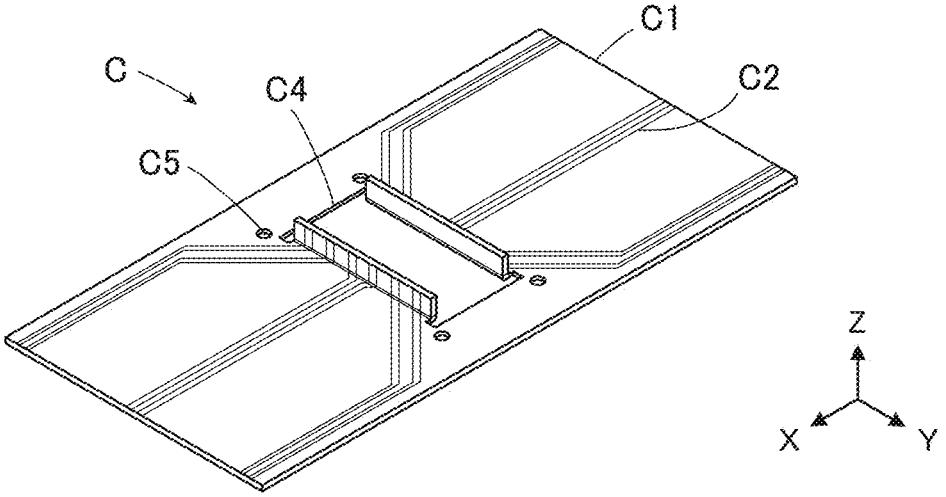
FIG. 63 is a perspective view of a connection object to which the connector according to Embodiment 4 is to be attached, as viewed from an obliquely upper position.

As shown in FIG. 63, in the connection object C, wiring made of a plurality of flexible conductors C2 is exposed on the top surface, which faces in the +Z direction, of a substrate C1 made of an insulating material. Although not shown in FIG. 63, the flexible conductors C2 are not exposed on the bottom surface, which faces in the −Z direction, of the substrate C1.

A rectangular opening C4 is formed in the substrate C1 of the connection object C, and one ends of the flexible conductors C2 are situated at the +X direction-side edge and the −X direction-side edge of the opening C4. The opening C4 receives the projection portion 45B of the first insulator 45 when the connector 41 is attached to the connection object C but is formed to be smaller in width in the X direction than the projection portion 45B of the first insulator 45. Therefore, with the portions of the connection object C situated at the +X direction-side edge and the −X direction-side edge of the opening C4 being bent toward the +Z direction side, the projection portion 45B of the first insulator 45 is inserted into the opening C4.

Further, four through-holes C5 are formed on the opposite sides in the X direction of the opening C4 of the substrate C1. These through-holes C5 correspond to the four fixing posts 47H of the second insulator 47, and the four fixing posts 47H pass through the four through-holes C5.

Attachment of the connector 41 to the connection object C is described below.

Figure 64:
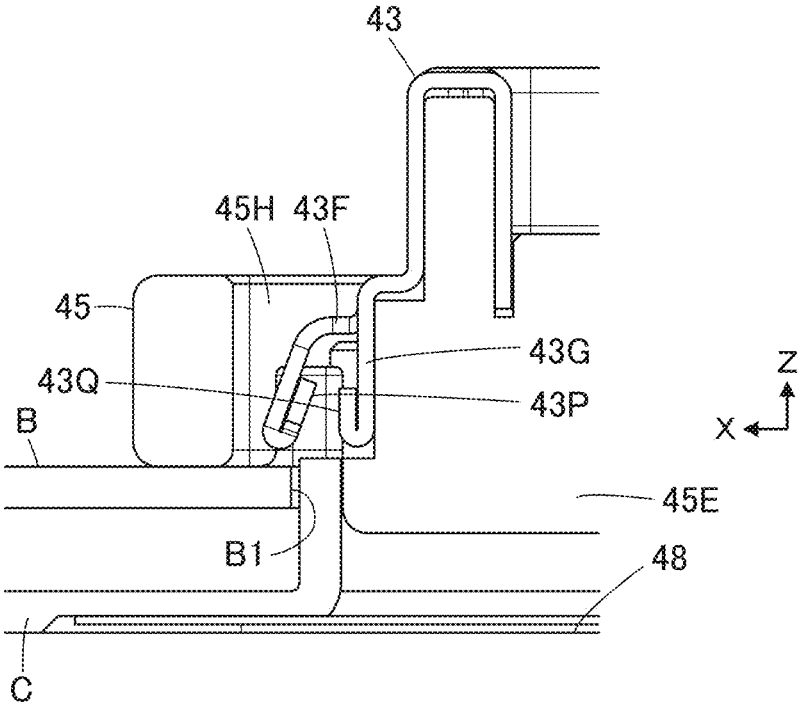
FIG. 64 is a view showing the state where assembling of the connection object to the first insulator is started.

First, the contacts 43 are assembled along the retaining grooves 45G and 45J of the first insulator 45 shown in FIGS. 56 and 57 from the +Z direction side. Consequently, as shown in FIG. 64, the first arm portion 43F and the second arm portion 43G of the contact 43 are placed in the through-hole 45H of the first insulator 45. In addition, the press-fitted portions 43N of the contact 43 shown in FIG. 61 are inserted into an insertion hole formed in the base portion 45A in a region surrounded by the projection portion 45B of frame shape of the first insulator 45, although not shown in FIG. 64.

Further, the projection portion 45E of the first insulator 45 is inserted into the opening B1 of the tab sheet B. The connection object C is disposed on the third insulator 48, and the +X direction-side edge and the −X direction-side edge of the opening C4 of the connection object C shown in FIG. 63 are bent toward the +Z direction side.

In this state, the connection object C is positioned such that the +X direction-side edge and the −X direction-side edge of the opening C4 of the connection object C are each situated between the first connection portion 43P and the second connection portion 43Q of the contact 43 in the X direction. Subsequently, the +X direction-side edge and the −X direction-side edge of the opening C4 of the connection object C are each inserted into a gap between the opening B1 of the tab sheet B and the projection portion 45E of the first insulator 45 from the −Z direction side, and the connection object C is further moved in the +Z direction.

Figure 65:
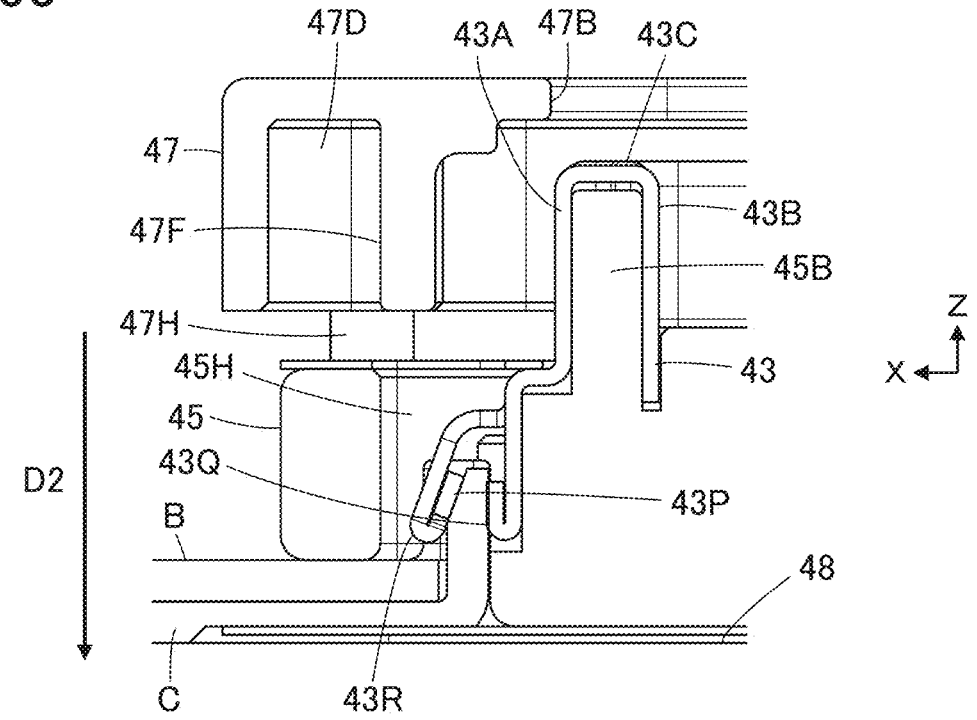
FIG. 65 is a view showing the state where assembling of the second insulator to the first insulator is started.

In this manner, the +X direction-side edge and the −X direction-side edge of the opening C4 of the connection object C are each inserted between the first connection portion 43P and the second connection portion 43Q of the contact 43 as shown in FIG. 65.

Next, the second insulator 47 is placed on the +Z direction side of the first insulator 45 and positioned such that the projection portion 45B of the first insulator 45 and the first flat plate portion 43A, the fixing portion 43B and the joint portion 43C of each contact 43 are situated inside the opening 47B of the second insulator 47 when viewed in the Z direction and that each convex portion 47F of the second insulator 47 is situated between the inner wall of the through-hole 45H of the first insulator 45 and the edge of the connection object C being bent toward the +Z direction side.

In this state, when the second insulator 47 is moved in the −Z direction which is a predetermined assembling direction D2, the convex portion 47F of the second insulator 47 enters the through-hole 45H of the first insulator 45. At this time, the pressing force applying surface 47G of the convex portion 47F makes contact with the pressing force receiving portion 43R of the contact 43 and applies, to the pressing force receiving portion 43R, a pressing force acting toward the second connection portion 43Q side. As a result, the first connection portion 43P of the contact 43 is displaced to approach the second connection portion 43Q in the X direction.

Figure 66:
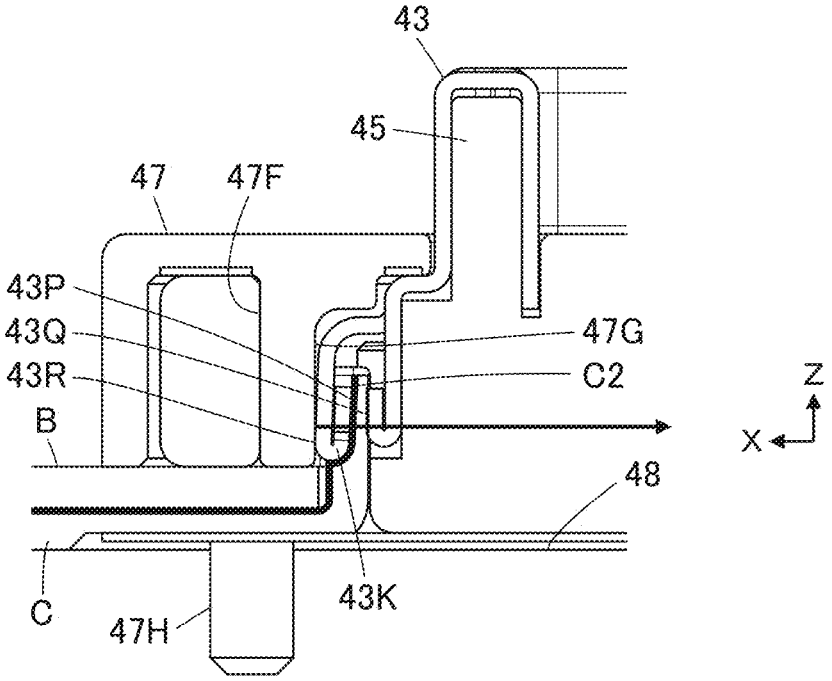
FIG. 66 is an enlarged view of an important part of FIG. 55.
Figure 67:
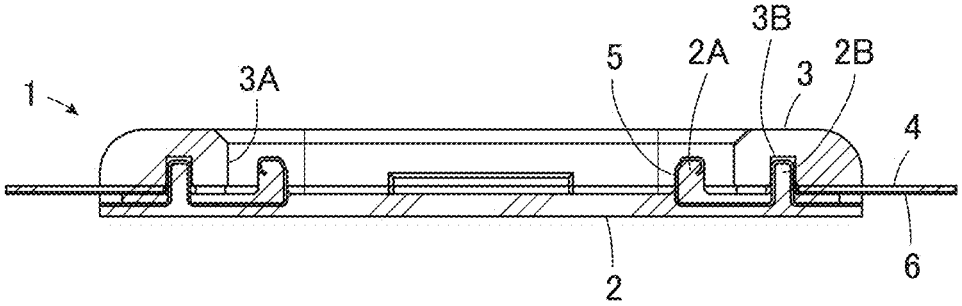
FIG. 67 PRIOR ART
FIG. 67 is a cross-sectional view showing a conventional connector.
Figure 68:
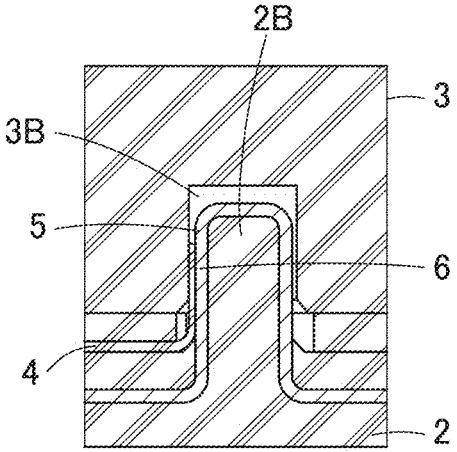
FIG. 68 PRIOR ART
FIG. 68 is an enlarged view of an important part of FIG. 67.

The second insulator 47 is further moved in the −Z direction until the convex portion 47F of the second insulator 47 is totally accommodated in the through-hole 45H of the first insulator 45 as shown in FIG. 66. Although not shown in FIG. 66, in this process, the four fixing posts 47H of the second insulator 47 pass near the four cutout portions 45D of the first insulator 45 shown in FIG. 56.

Finally, the four fixing posts 47H of the second insulator 47 are inserted into the four through-holes C5 of the connection object C shown in FIG. 63 and the four through-holes 48A of the third insulator 48 shown in FIG. 58, and the −Z directional ends of the four fixing posts 47H projecting from the four through-holes 48A of the third insulator 48 are heated and deformed whereby the second insulator 47 is fixed to the first insulator 45.

With this process, attachment of the connector 41 to the connection object C is completed as shown in FIG. 55.

As shown in FIG. 66, in the connector 41, the pressing force receiving portion 43R of the contact 43 situated on the +X direction side receives a pressing force acting in the −X direction from the pressing force applying surface 47G formed on the convex portion 47F of the second insulator 47, whereby the first connection portion 43P is pressed against the surface on the +X direction side of the edge of the connection object C being bent toward the +Z direction side. Accordingly, the first connection portion 43P and the second connection portion 43Q of the contact 43 are pressed against the edge of the connection object C from the opposite sides thereof in the X direction. Since the flexible conductors C2 of the connection object C are exposed on the side facing the first connection portion 43P, the flexible conductors C2 make contact with the first connection portion 43P. Thus, the flexible conductors C2 of the connection object C are electrically connected to the contacts 43 via the first connection portion 43P.

Further, the pressing force receiving portion 43R of the contact 43 situated on the −X direction side receives a pressing force acting in the +X direction from the pressing force applying surface 47G formed on the convex portion 47F of the second insulator 47. Accordingly, the first connection portion 43P and the second connection portion 43Q are pressed against the edge of the connection object C from the opposite sides thereof in the X direction. Thus, the contact 43 situated on the −X direction side is also electrically connected to the flexible conductors C2 of the connection object C in the same manner as the contact 43 situated on the +X direction side.

As described above, in the connector 41 according to Embodiment 4 of the invention, the opposite surfaces of the connection object C are sandwiched between the first connection portion 43P and the second connection portion 43Q of the contact 43; therefore, even when the flexible conductors C2 are exposed on, of the opposite surfaces, either surface of the substrate C1, the corresponding one of the first connection portion 43P and the second connection portion 43Q makes contact with the flexible conductors C2, thus establishing a reliable electrical connection between the flexible conductors C2 and the contact 43.

Moreover, the first connection portion 43P and the second connection portion 43Q of the contact 43 do not contact the first insulator 45 or the second insulator 47 as shown in FIG. 66, and this configuration makes it possible to prevent the connection object C from being scratched by the first insulator 45 or the second insulator 47 in making an electrical connection between the flexible conductors C2 and the contact 43.

Furthermore, the connection object C receives a force acting in the X direction perpendicular to the −Z direction, which is the predetermined assembling direction D2, from the first connection portion 43P and the second connection portion 43Q of the contact 43; therefore, it is unlikely that the second insulator 47 assembled with the first insulator 45 is separated from the first insulator 45 due to the force to sandwich the connection object C by the first and second connection portions 43P and 43Q of the contact 43, thus making it possible to maintain the connector 41 in a stable state. The direction in which the first connection portion 43P and the second connection portion 43Q sandwich the connection object C therebetween need not necessarily be perpendicular to the predetermined assembling direction D2 but preferably crosses the predetermined assembling direction D2.

While in the connector 41 according to Embodiment 4, the first insulator 45 and the second insulator 47 are fixed to each other by means of the third insulator 48, the first insulator 15 and the second insulator 17 may be fixed to each other by means of the third insulator 48 even in the connector 11 of Embodiment 1. For instance, a plurality of fixing posts extending in the −Z direction are formed on the first insulator 15, a plurality of through-holes corresponding to the fixing posts of the first insulator 15 are formed in the second insulator 17, the fixing posts of the first insulator 15 are inserted into the through-holes of the second insulator 17, and the −Z directional ends of the fixing posts are heated and deformed, whereby the first insulator 15 and the second insulator 17 are fixed to each other. Likewise, also in the connector 21 according to Embodiment 2 and the connector 31 according to Embodiment 3, the first insulator 25 and the second insulator 27 may be fixed to each other by means of the third insulator 48, and the same holds for the first insulator 35 and the second insulator 37.

While in Embodiments 1 to 4, the connector 11, 21, 31, 41 is attached to the connection object C along with the tab sheet B for reinforcing the connection object C, the tab sheet B may be omitted when it is not necessary to reinforce the connection object C.

What is claimed is:

1. A connector attached to a connection object having a flexible conductor exposed on at least one surface of the connection object, the connector comprising:

a first insulator;

a second insulator assembled to the first insulator in a predetermined assembling direction; and at least one contact made of a conductive material, wherein the contact includes a contact portion that is to make contact with a contact of a counter connector, a retained portion that is retained between the first insulator and the second insulator, a first connection portion and a second connection portion that face each other and make contact with opposite surfaces of the connection object, and a pressing force receiving portion that makes contact with the second insulator and receives a pressing force from the second insulator to thereby press the first connection portion against the second connection portion, the connection object is sandwiched between the first connection portion and the second connection portion, and at least one of the first connection portion and the second connection portion makes contact with the flexible conductor of the connection object, whereby the contact is electrically connected to the flexible conductor of the connection object.

2. The connector according to claim 1, wherein the second insulator is assembled to the first insulator by being linearly moved in the predetermined assembling direction, and the pressing force receiving portion receives the pressing force acting in a direction crossing the predetermined assembling direction from the second insulator.

3. The connector according to claim 1, wherein the contact includes a first arm portion and a second arm portion, the first connection portion and the pressing force receiving portion are disposed in the first arm portion, and the second connection portion is disposed in the second arm portion.

4. The connector according to claim 3, wherein the contact portion is connected to one end of the retained portion, the first arm portion and the second arm portion are connected to the other end of the retained portion and each have an end forming a free end, the first connection portion is disposed at the end of the first arm portion so as to face the second connection portion, and the second connection portion is disposed at the end of the second arm portion so as to face the first connection portion.

5. The connector according to claim 3, wherein one end of the contact portion is connected to one end of the retained portion, the first arm portion is connected to the other end of the contact portion and has an end forming a free end, the second arm portion is connected to the other end of the retained portion and has an end forming a free end, the first connection portion is disposed at the end of the first arm portion so as to face the second connection portion, and the second connection portion is disposed at the end of the second arm portion so as to face the first connection portion.

6. The connector according to claim 4, wherein the pressing force receiving portion is disposed at the end of the first arm portion so as to face an opposite side from the second connection portion.

7. The connector according to claim 6, wherein the connection object is sandwiched between the first connection portion and the second connection portion in a direction crossing the predetermined assembling direction.

8. The connector according to claim 4, wherein the first arm portion has a bent portion formed near the end of the first arm portion, and the pressing force receiving portion is disposed in the bent portion so as to face an opposite side from the second connection portion.

9. The connector according to claim 8, wherein the connection object is sandwiched between the first connection portion and the second connection portion in the predetermined assembling direction.

10. The connector according to claim 1, wherein the first insulator includes a first surface that faces the second insulator and extends in a direction crossing the predetermined assembling direction and a recess portion that is dented in the predetermined assembling direction from the first surface, the second insulator includes a second surface that faces the first insulator and extends in a direction crossing the predetermined assembling direction and a convex portion that projects in the predetermined assembling direction from the second surface, and the second insulator is assembled to the first insulator with the connection object being sandwiched between the first surface and the second surface and the convex portion being accommodated in the recess portion.

11. The connector according to claim 10, wherein the convex portion has a guide surface inclined to the predetermined assembling direction, and the pressing force receiving portion is displaced by the guide surface such that the first connection portion approaches the second connection portion when the second insulator is assembled to the first insulator in the predetermined assembling direction.

12. The connector according to claim 11, wherein the convex portion has a pressing force applying surface situated adjacent to the guide surface and extending in the predetermined assembling direction, and the pressing force receiving portion receives the pressing force from the pressing force applying surface.

13. The connector according to claim 10, wherein the second connection portion is disposed along an inner surface of the recess portion, the convex portion includes a connection object bending portion having a surface facing in the predetermined assembling direction, and the connection object is bent toward the predetermined assembling direction by the connection object bending portion so as to face the second connection portion when the second insulator is assembled to the first insulator in the predetermined assembling direction.

14. The connector according to claim 10, wherein the first insulator has a second connection portion placement surface that is disposed between an opening end of the recess portion and the first surface and extends in a direction crossing the predetermined assembling direction, the second connection portion is disposed along the second connection portion placement surface so as to be exposed to the second insulator, and the connection object is disposed on the first surface of the first insulator and the second connection portion.

15. The connector according to claim 1, wherein the first insulator has a through-hole extending in the predetermined assembling direction, the first connection portion and the second connection portion are disposed inside the through-hole, the second insulator has a convex portion inserted, from one end of the through-hole, into the through-hole extending in the predetermined assembling direction, the convex portion has a pressing force applying surface extending in the predetermined assembling direction, and the connection object having been inserted, from the other end of the through-hole, into the through-hole extending in the predetermined assembling direction is disposed between the first connection portion and the second connection portion, and the pressing force receiving portion receives the pressing force from the pressing force applying surface of the convex portion inserted in the through-hole.

16. The connector according to claim 1, further comprising a third insulator for fixing the second insulator to the first insulator.

* * * * *